US012703955B2

(12) United States Patent
Frost et al.

(10) Patent No.: US 12,703,955 B2
(45) Date of Patent: Aug. 11, 2026

(54) BIO-INSPIRED ENGINEERED TRANSITION ZONE (BID-ETTZ) ENERGY PILES

(71) Applicant: Georgia Tech Research Corporation, Atlanta, GA (US)

(72) Inventors: J. David Frost, Atlanta, GA (US); Fikret Atalay, Atlanta, GA (US); Michael Helms, Atlanta, GA (US); Marc Weissburg, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 18/787,874

(22) Filed: Jul. 29, 2024

(65) Prior Publication Data

US 2025/0034830 A1 Jan. 30, 2025

Related U.S. Application Data

(60) Provisional application No. 63/515,870, filed on Jul. 27, 2023.

(51) Int. Cl.
*E02D 31/00* (2006.01)
*E02D 5/24* (2006.01)

(52) U.S. Cl.
CPC ..... *E02D 31/00* (2013.01); *E02D 5/24* (2013.01); *E02D 2600/00* (2013.01)

(58) Field of Classification Search
CPC ..... E02D 31/00; E02D 5/24; E02D 2600/00; Y02E 10/10
See application file for complete search history.

(56) References Cited

U.S. PATENT DOCUMENTS 4,818,148 A * 4/1989 Takeda ..... E02D 5/60 405/234
2024/0093915 A1* 3/2024 Zhang ..... F24T 10/15

OTHER PUBLICATIONS

Akrouch, G. A., Sánchez, M. and Briaud, J. L. (2014). Thermo-mechanical behavior of energy piles in high plasticity clays. Acta Geotechnica, 9(3), pp. 399-412. doi: 10.1007/s11440-014-0312-5.
Amatya, B. L., Soga, K, Bourne-Webb, P.J., Amis, T. and Laloui, L. (2012). Thermo-mechanical behaviour of energy piles. Géotechnique, 62(6), pp. 503-519. doi: 10.1680/geot.10.P.116.

(Continued)

*Primary Examiner* — Kyle Armstrong
(74) *Attorney, Agent, or Firm* — Meunier Carlin & Curfman LLC

(57) ABSTRACT

An exemplary system and method for enhanced structural and thermal structure having an engineered thermal transition zone that integrates with an energy pile section having foundation pile for retaining engineered material or soil and thermal cooling loop that circulate through the material. An apparatus includes an outer surface extending between a first end and a second end of the section; an inner surface spaced apart and radially inward from the outer surface and defining a central channel of the apparatus; a thermal transition zone extending between the outer surface and the inner surface, the thermal transition zone configured to facilitate heat transfer between the inner surface and the outer surface; and a conductive conduit extending through at least the thermal transition zone from the first end to the second end of the apparatus.

19 Claims, 23 Drawing Sheets

(56) References Cited

OTHER PUBLICATIONS

Atalay, F. (2017). Punctuated equilibrium and policy diffusion : An application to energy foundations. The 6th International Young Geotechnical Engineers' Conference, pp. 5-7.
Atalay, F. (2019). Engineered Transition Zone Systems for Enhanced Heat Transfer in Thermo-Active Foundations. PhD Dissertation, Georgia Institute of Technology, Atlanta, USA.
Atalay, F. and Frost, J. D. (2016). Engineered transition zone for enhanced heat transfer in energy pile foundations. Proceedings of the 19th International Conference on Soil Mechanics and Geotechnical Engineering, pp. 3419-3422.
Bourne-Webb, P. J., Amatya, B., Soga, K., Amis, T., Davidson, C. and Payne, P. (2009). Energy pile test at Lambeth College, London: geotechnical and thermodynamic aspects of pile response to heat cycles. Géotechnique, 59(3), pp. 237-248. doi: 10.1680/geot.2009.59.3.237.
Bourne-Webb, P. J., Amatya, B. and Soga, K. (2013). A framework for understanding energy pile behavior. Proceedings of the Institution of Civil Engineers—Geotechnical Engineering, 166(2), pp. 170-177. doi: 10.1680/geng.10.00098.
Brandl, H. (2006). Energy foundations and other thermo-active ground structures. Géotechnique, 56(2), pp. 81-122. doi: 10.1680/geot.2006.56.2.81.
Bozis, D., Papakostas, K. and Kyriakis, N. (2011). On the evaluation of design parameters effects on the heat transfer efficiency of energy piles. Energy and Buildings. Elsevier B.V., 43(4), pp. 1020-1029. doi: 10.1016/j.enbuild.2010.12.028.
Cecinato, F. and Loveridge, F. A. (2015). Influences on the thermal efficiency of energy piles. Energy, 82, pp. 1021-1033. doi: 10.1016/j.energy.2015.02.001.
Dupray, F., Laloui, L. and Kazangba, A. (2014). Numerical analysis of seasonal heat storage in an energy pile foundation. Computers and Geotechnics. Elsevier Ltd, 55, pp. 67-77. doi: 10.1016/j.compgeo.2013.08.004.
Jalaluddin and Miyara, A., (2012). Thermal performance investigation of several types of vertical ground heat exchangers with different operation mode. Applied Thermal Engineering, 33, pp. 167-174.
Knellwolf, C., Peron, H. and Laloui, L. (2011). Geotechnical Analysis of Heat Exchanger Piles. Journal of Geotechnical and Geoenvironmental Engineering, 137(10), pp. 890-902. doi: 10.1061/(ASCE)GT.1943-5606.0000513.
Laloui, L., Nuth, M. and Vulliet, L. (2006). Experimental and numerical investigations of the behaviour of a heat exchanger pile. International Journal for Numerical and Analytical Methods in Geomechanics, 30(8), pp. 763-781. doi: 10.1002/nag.499.
Loveridge, F. and Powrie, W. (2014). 2D thermal resistance of pile heat exchangers. Geothermics. CNR-Istituto di Geoscienze e Georisorse, 50, pp. 122-135. doi: 10.1016/j.geothermics.2013.09.015.
Mimouni, T. and Laloui, L. (2014). Towards a secure basis for the design of geothermal piles. Acta Geotechnica, 9(3), pp. 355-366. doi: 10.1007/s11440-013-0245-4.
Nguyen, V. T., Tang, A. M. and Pereira, J. M. (2017). Long-term thermo-mechanical behavior of energy pile in dry sand. Acta Geotechnica. Springer Berlin Heidelberg, 12(4), pp. 729-737. doi: 10.1007/s11440-017-0539-z.
Sánchez, M. et al. (2017). Salient comments from an expert panel on energy geotechnics. Environmental Geotechnics, 4(2), pp. 135-142. doi: 10.1680/jenge.16.00008.
Suryatriyastuti, M. E., Mroueh, H. and Burlon, S. (2012). Understanding the temperature-induced mechanical behaviour of energy pile foundations. Renewable and Sustainable Energy Reviews. Elsevier Ltd, 16(5), pp. 3344-3354. doi: 10.1016/j.rser.2012.02.062.
U.S. Energy Information Administration (2017). International Energy Outlook 2017. International Energy Outlook, IEO2017(2017), p. 143. doi: www.eia.gov/forecasts/ieo/pdf/0484(2016).pdf.
Zarrella, A., De Carli, M. and Galgaro, A. (2013). Thermal performance of two types of energy foundation pile: Helical pipe and triple U-tube. Applied Thermal Engineering. Elsevier Ltd, 61(2), pp. 301-310. doi: 10.1016/j.applthermaleng.2013.08.011.

* cited by examiner

BIO-INSPIRED ENGINEERED TRANSITION ZONE (BID-ETTZ) ENERGY PILES

CROSS-REFERENCE

This application claims priority to U.S. Provisional Patent Application No. 63/515,870, filed Jul. 27, 2023, which is incorporated by reference in its entirety.

TECHNICAL FIELD

The systems, devices, and methods disclosed herein relate to ground heat exchange systems.

BACKGROUND

Buildings and various dwelling structures can employ an underground heat exchanger—ground-coupled heat exchanger—that can capture heat from and/or dissipate heat to the ground. The heat exchanger uses the Earth's near-constant subterranean temperature to warm or cool air or other fluids for residential, agricultural, or industrial uses.

Buildings and various dwelling structures also have foundations, such as piles, as structural members that transmit loads from the superstructure to bedrock or a stronger layer of soil. A pile is a type of foundation that can be made of steel, concrete, or timber.

Energy piles (EPs) are dual-purpose foundation members that provide support to above-ground structures, as well as functioning as ground-coupled heat exchangers. The ground maintains a relatively constant temperature after reaching a certain depth (typically about 5 m), and EPs can take advantage of this to dissipate heat during warm periods and extract heat in cool periods. In some systems, a fluid is pumped through pipes set into the concrete energy piles, the fluid exchanging heat with the EP and the surrounding substrate (e.g., soil) before returning to the surface.

There is a benefit to improving the construction and thermal regulation of building structures.

SUMMARY

An exemplary system and method are disclosed that employs enhanced structural and thermal structure having an engineered thermal transition zone (ETTZ) that integrates with an energy pile section having a foundation pile for retaining engineered material or soil and a thermal cooling loop that circulates through the material to provide enhanced structural support and thermal regulation for buildings. The engineered thermal transition zone is inspired by root and/or plant stem structures and can be pre-manufactured in sections for storage and transportation to then be assembled at the local site. The exemplary system and method, via the engineered thermal transition zone, can improve the overall heat transfer of energy piles by 2× or more over conventional thermal regulation loop and thus can either (i) reduce the depth of an installed pile and/or thermal loop or (ii) reduce the number of piles and/or thermal loops. ETTZ-integrated energy piles can provide a sustainable solution to rising energy demand by (i) reducing the energy footprint of the building during use by drawing energy from a renewable source and (ii) reducing the energy footprint of the building during construction.

In some examples, the Engineered Thermal Transition Zone (ETTZ) systems incorporate bioinspired elements (e.g., plant stems and the xylem structure within) that incorporate superior structural and thermal components. Compared to existing systems, the ETTZ systems provide high thermal diffusivity and reduced thermal resistance/impedance. The ETTZ systems also remove the geometrical constraints for the number and configuration of fluid circulation tubes. By decoupling the structural and thermal components, each of the structural and thermal functions can be optimized. Both numerical model and laboratory chamber test results indicate that it is possible to significantly increase the thermal performance of shallow thermo-active foundations using an engineered thermal transition zone (ETTZ).

In an aspect, an apparatus (e.g., a section of a column, pier, or pile) is disclosed configured for thermal and/or structural support, the apparatus comprising: an outer surface extending between a first end and a second end of the section; an inner surface spaced apart and radially inward from the outer surface and defining a central channel of the apparatus; a thermal transition zone extending between the outer surface and the inner surface, the thermal transition zone configured to facilitate heat transfer between the inner surface and the outer surface; and a conductive conduit extending through at least the thermal transition zone from the first end to the second end of the apparatus and spiraling around the central channel of the section with a pitch, the conductive conduit configured to transfer heat into the thermal transition zone.

In some embodiments, the inner surface further comprises a pattern of radial projections defining a first circumference and a second circumference disposed radially inward of the first circumference of the inner surface, wherein the second circumference of the inner surface defines the central channel of the apparatus.

In some embodiments, the thermal transition zone comprises a plurality of cells extending between the outer surface and the inner surface to define a patterned network of the plurality of cells.

In some embodiments, each cell of the plurality of cells is hexagonal in shape.

In some embodiments, the conductive conduit further extends through at least a portion of the inner surface.

In some embodiments, the conductive conduit further extends through the pattern of radial projections of the inner surface.

In some embodiments, the diameter of the central channel is about one-third of the diameter of the outer surface.

In some embodiments, the outer surface is substantially circular.

In some embodiments, the outer surface further comprises at least one projection extending radially outward and configured for increased thermal conductivity.

In some embodiments, the apparatus is configured to couple to one or more additional apparatus, including a second apparatus, to form a structural pile, wherein the second apparatus comprises: an outer surface extending between a first end and a second end of the section; an inner surface spaced apart and radially inward from the outer surface, the inner surface comprising a pattern of radial projections defining a first circumference and a second circumference disposed radially inward from the first circumference of the inner surface, wherein the second circumference of the inner surface defines a central channel of the section; a thermal transition zone extending between the outer surface and the inner surface, the thermal transition zone configured to facilitate heat transfer between the inner surface and the outer surface; and a conductive conduit extending through at least the thermal transition zone from the first end to the second end of the section and spiraling around the central channel of the section with a pitch, the conductive conduit configured to transfer heat into the thermal transition zone.

In an aspect, a pile is disclosed comprising: a structural pile comprising a first end and a second end opposite and spaced apart from the first end, the structural pile configured to support a load; a thermal pile disposed around the structural pile, wherein the pile has enhanced thermal properties compared to the structural pile, the thermal pile comprising: an outer surface extending between a first end and a second end of the thermal pile; an inner surface spaced apart and radially inward from the outer surface defining a central channel of the apparatus within which the structural pile is disposed; a thermal transition zone extending between the outer surface and the inner surface, the thermal transition zone configured to facilitate heat transfer between the inner surface and the outer surface; and a conductive conduit extending through at least the thermal transition zone from the first end to the second end of the thermal pile and spiraling around the central channel of the section with a pitch, the conductive conduit configured to transfer heat into the thermal transition zone.

In some embodiments, the inner surface further comprises a pattern of radial projections defining a first circumference and a second circumference disposed radially inward of the first circumference of the inner surface, wherein the second circumference of the inner surface defines the central channel of the apparatus.

In some embodiments, the pile is installed in a bulk material, and heat is transferred from the conductive conduit, through the thermal transition zone, and into the bulk material.

In some embodiments, the pile includes a fluid pumping system comprising a fluid source coupled to and in fluid communication with the conductive conduit and a pump configured to urge fluid from the fluid source along the conductive conduit.

In some embodiments, a diameter of the structural pile is 12 inches, and a diameter of the outer surface of the thermal pile is 36 inches.

In some embodiments, the second end of the structural pile extends beyond the second end of the thermal pile.

In some embodiments, the second end of the thermal pile extends beyond the second end of the structural pile.

In some embodiments, the thermal transition zone comprises a plurality of cells extending between the outer surface and the inner surface to define a patterned network of the plurality of cells.

In another aspect, a method is disclosed for fabricating a structural and thermal pile system, the method comprising: providing a thermal pile comprising: an outer surface extending between a first end and a second end of the thermal pile; an inner surface spaced apart and radially inward from the outer surface and defining a central channel within which the structural pile is disposed; a thermal transition zone extending between the outer surface and the inner surface, the thermal transition zone configured to facilitate heat transfer between the inner surface and the outer surface; and a conductive conduit extending through at least the thermal transition zone from the first end to the second end of the thermal pile and spiraling around the central channel of the section with a pitch, the conductive conduit configured to transfer heat into the thermal transition zone. The method then includes installing the thermal pile into a bulk material (e.g., the ground); and installing a structural pile into the central channel of the thermal pile, a structural pile comprising a first end and a second end opposite and spaced apart from the first end.

In some embodiments, the method includes coupling the conductive conduit to a fluid pumping system comprising a fluid pump and a fluid source in fluid communication with the conductive conduit and activating the fluid pump to urge fluid from the fluid source and through the conductive conduit.

In some embodiments, heat from the fluid is transferred into the thermal transition zone of the thermal pile and further into the bulk material.

In some embodiments, the thermal transition zone comprises a plurality of cells extending between the outer surface and the inner surface to define a patterned network of the plurality of cells.

In some embodiments, the method includes depositing flowable fill in the patterned network.

BRIEF DESCRIPTION OF THE DRAWINGS

FIGS. 3A-3I show examples of ETTZ energy pile sections in accordance with various illustrative embodiments.

Figure 1A:
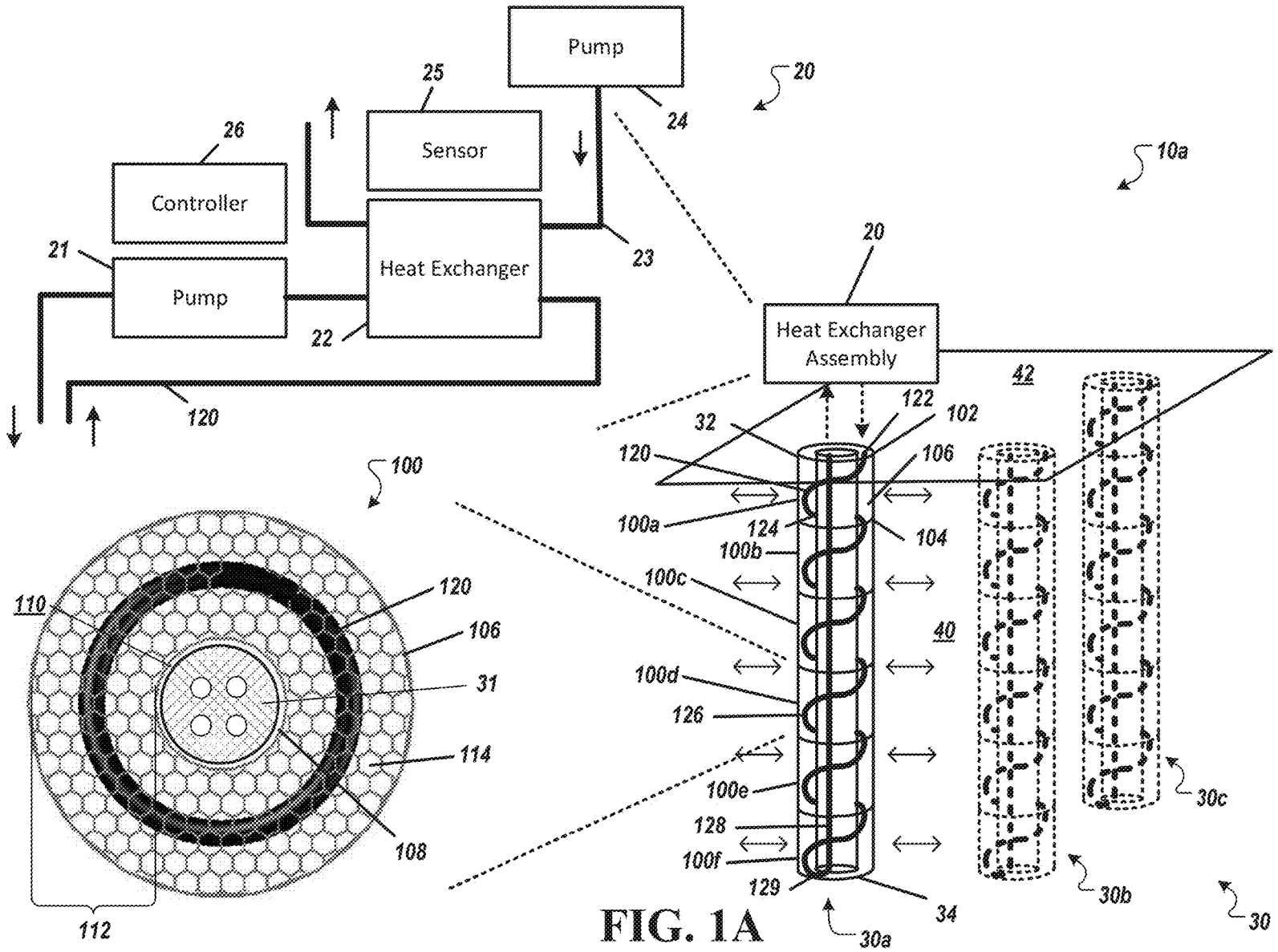
FIGS. 1A and 1B each show a diagram of an engineered-thermal-transition-zone energy pile having at least one engineered thermal transition zone configured for thermal and/or structural support in accordance with various illustrative embodiments.

A number of drawings are included herein. Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Some references, which may include various patents, patent applications, and publications, are cited in a reference list and discussed in the disclosure provided herein. The citation and/or discussion of such references is provided merely to clarify the description of the present disclosure and is not an admission that any such reference is "prior art" to any aspects of the present disclosure described herein. In terms of notation, "[n]" corresponds to the $n^{th}$ reference in a first list, and "[n']" corresponds to the reference in a second list. All references cited and discussed in this specification are incorporated herein by reference in their entirety and to the same extent as if each reference was individually incorporated by reference.

Example Systems

Figure 1B:
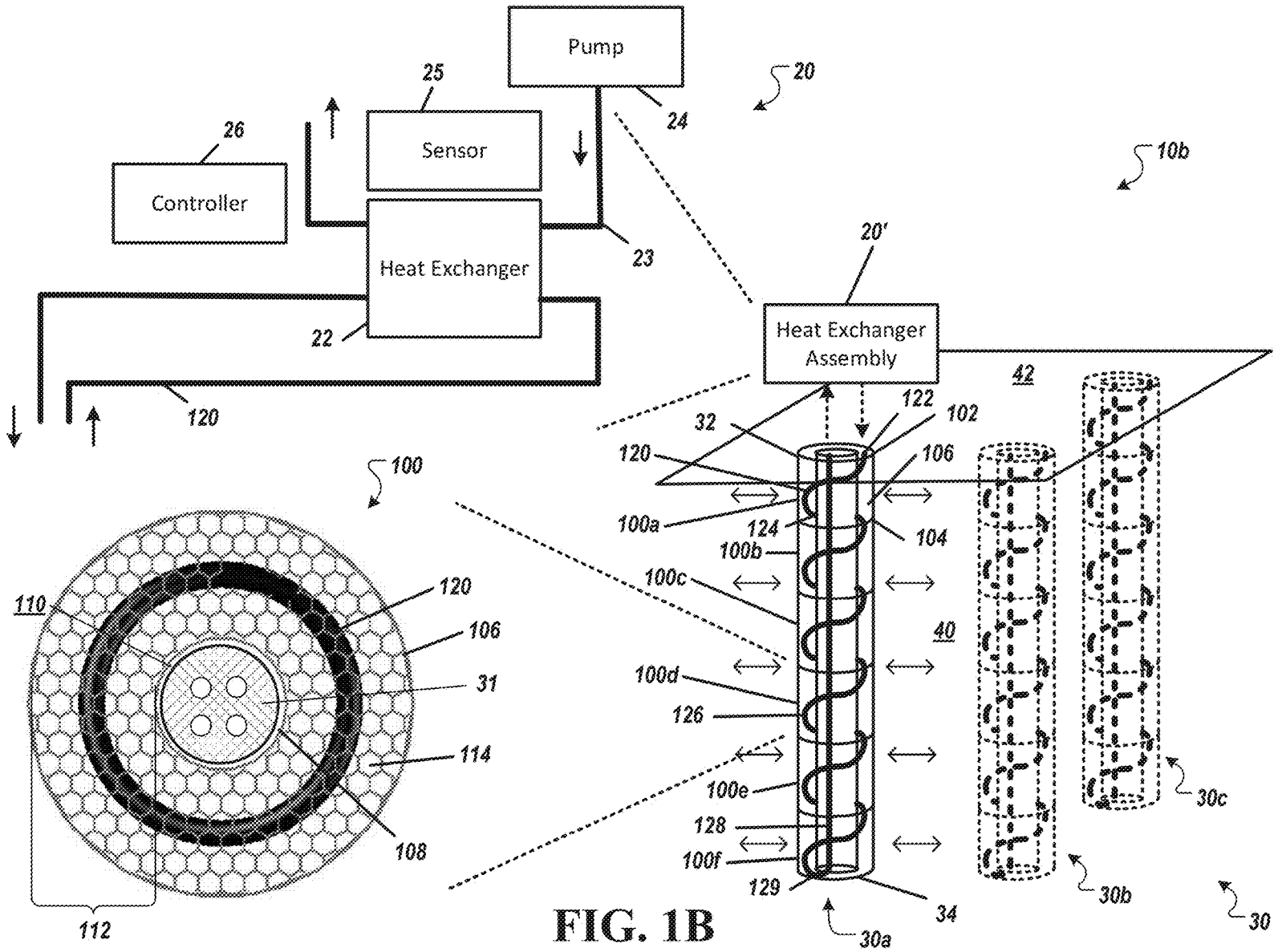

FIGS. 1A and 1B each show a diagram of a heat transfer and pile system 10 (shown as 10*a* and 10*b*) having at least one engineered thermal transition zone (ETTZ) apparatus 100 (hereinafter "apparatus 100") configured for thermal and/or structural support. In the example shown in each of FIGS. 1A and 1B, the system 10*a*, 10*b* each include a heat exchanger assembly 20 and at least one ETTZ energy pile 30 (shown as 30*a*, 30*b*, 30*c*) comprised of a plurality of apparatuses 100 (shown as 100*a*-100*f*) defining an engineering thermal transition zone.

In FIG. 1A, the apparatuses 100 are configured as part of a close loop circulation system with the heat exchanger assembly 20. In FIG. 1B, the apparatuses 100 are configured as a heat-pipe. The apparatuses 100, collectively, form a base structure for an enhanced structural and thermal structure having an engineered thermal transition zone and integrates with an ETTZ energy pile 30 having a foundation pile for retaining engineered material or soil and includes sectionalized thermal cooling loop that when assembled forms a loop, to circulate fluid through the material in the thermal transitioned zone to provide enhanced structural support and thermal regulation for buildings.

In the example shown in FIG. 1A, the system 10*a* includes an ETTZ energy pile 30 comprising a plurality of apparatuses 100 (also referred to as "sections" or "devices" 100). The system 10*a* may include one or more internal pile structures 31. For example, system 10*a* in FIG. 1A shows an ETTZ energy pile 30*a* adjacent to a second ETTZ energy pile 30*b* and a third ETTZ energy pile 30*c*, shown in shadow lines. The system may include additional piles, e.g., 4, 5, 6, 7, 8, 9, 10, 20, 30, 40, or more piles depending on the construction project and building type.

The ETTZ energy pile 30*a* includes a number of apparatuses 100. In FIG. 1A, six apparatuses 100 are shown labeled as apparatus 100*a*-100*f*, each coupled to and in thermal communication by a conductive conduit 120 (e.g., pipe) with each other. Together, the six apparatuses form a single ETTZ energy pile 30*a*. Throughout this disclosure, reference will be made to the unit section of the apparatuses 100 (i.e., an apparatus 100 having a given height and diameter). However, it is understood that an "apparatus" or a "stack" of multiple apparatuses 100 forms the ETTZ energy pile 30 and may comprise any number of individual sections. The "engineered thermal transition zone (ETTZ)" is defined by a plurality of unit cells together forming the singular "apparatus", "stack", or "pile."

The ETTZ energy pile 30*a* is disposed within a substrate 40 (e.g., Earth or ground). A top end 32 of the ETTZ energy pile 30*a* is exposed to a ground surface 42 of the substrate 40, and a bottom end 34 of the pile 30*a* opposite from the top end 32 is disposed underground further from the ground surface 42 (e.g., between 5 ft and 200 ft, such as about 5 ft, 10 ft, 15 ft, 20 ft, 25 ft, 30 ft, 35 ft, 40 ft, 45 ft, 50 ft, 55 ft, 60 ft, 65 ft, 70 ft, 75 ft, 80 ft, 85 ft, 90 ft, 95 ft, 100 ft, 105 ft, 110 ft, 115 ft, 120 ft, 125 ft, 130 ft, 135 ft, 140 ft, 145 ft, 150 ft, 155 ft, 160 ft, 165 ft, 170 ft, 175 ft, 180 ft, 185 ft, 190 ft, 195 ft, 200 ft). In some embodiments, the piles 30*a* is over 200 ft.

FIG. 1A shows a cross-section of an apparatus 100 (e.g., a section of the ETTZ energy pile 30*a*), according to one implementation, which shows the ETTZ 112. The apparatus 100 (e.g., the apparatus 100*d* as a section of the ETTZ energy pile 30*a*) includes a first end 102 and a second end 104 opposite and spaced apart from the first end 102. The apparatus 100 includes an outer surface 106 extending between the first end 102 and the second end 104 for a section of the pile 30. The apparatus 100 further includes an inner surface 108 spaced apart radially inward from the outer surface 106. The inner surface 108 defines a central channel 110 of the apparatus 100 to interact with a pile structure 31. The outer surface 106 contacts the substrate 40. The space in between the inner surface 108 and the outer surface 106 is the engineered thermal transition zone 112. The apparatus 100 is pre-molded or pre-manufactured to have internal structures to retain material in the engineered thermal transition zone 112 that can provide enhanced thermal transition regions with a thermal regulating conductive conduct 120.

In the example shown in FIG. 1A, the engineered thermal transition zone 112 includes a plurality of cells 114 defining a patterned network of cells. The plurality of cells 114 are each hexagons that form the patterned network of cells. However, in other implementations, a different shape of cells defines the patterned network of the thermal transition zone (e.g., see FIG. 4A). The term "engineered" refers to the apparatus as an engineered/manufactured structure as well as having engineered material placed therein in the plurality of cells 114.

The apparatus 100, including the outer surface 106, the inner surface 108, and the thermal transition zone 112 (as well as internal walls when present), may be manufactured via a 3D printing process (e.g., with plastic materials such as Polylactic acid (PLA), Acrylonitrile butadiene styrene (ABS), nylon, or cured resins, any of which may be fiber reinforced). In other implementations, the apparatus may be manufactured from plastic materials via traditional manufacturing methods (e.g., molding or casting). In other implementations, the apparatus is manufactured, at least in part, without plastic materials (e.g., biodegradable materials, metals, or composites).

The engineered thermal transition zone 112 may be filled with an aggregate or a flowable fill material (e.g., grout or other filler material which may include concrete, pond fines, or other quarry waste product with or without aggregate) within a reinforcement/retaining unit cell structure 114. In other embodiments, the engineered thermal transition zone 112 do not include the retaining unit cell structure 114 and is defined only by an external reinforcement structure defining the outer surface 106. In some implementations, an enhanced filler material is preferably used to fill the spaces of the plurality of cells 114. The aggregate or flowable fill material has an enhanced/improved thermal conductivity property greater than that of the surrounding substrate 40 to facilitate heat transfer thereto. A conductive additive may be added to the aggregate or the flowable fill material to increase the thermal conductivity of the enhanced filler. In other implementations, the thermal transition zone is a solid structure.

The apparatus 100 further includes a conductive conduit 120 disposed at least partially within the engineered thermal transition zone 112. The conductive conduit 120 is formed from a conductive material (e.g., metal), and is configured to contain a flow of fluid through a channel of the conductive conduit 120. The engineered thermal transition zone 112, as an intermediary, facilitates heat transfer from the conductive conduit 120 towards the outer surface 106 and into the surrounding substrate 40.

The conductive conduit 120 spirals the inner region 110 to provide a thermal regulating channel 110 with the engineered thermal transition zone 112 (e.g., in a screw-like pattern with a defined pitch). The conductive conduit 120 in the example in FIG. 1A is disposed radially midway between the outer surface 106 and the inner surface 108. In other implementations, the conductive conduit extends through the thermal transition zone in different radial positions (e.g., closer to or further away from the central channel 110).

A first end 122 of the conductive conduit 120 on the first end 102 of the apparatus 100*a* for pile 30*a* is configured to couple to a second end 124 of the conductive conduit 120 on the second end 104 of an adjacent apparatus 100*b*. In some embodiments, the first end 122 and the second end 124 of the conductive conduit 120 may include a valve, coupling, or mating structure to facilitate the coupling of two apparatuses 100. The two apparatuses 100 may couple together and the conductive conduit 120 of each may be bonded together with an epoxy or with a purely mechanical coupling. Once coupled, the conductive conduits 120 of adjacent apparatuses 100 are in fluid communication with each other.

The conductive conduit 120 provides a thermal connection with the heat exchanger assembly 20 through the ETTZ energy pile 30*a* from the uppermost apparatus 100*a* to the lowermost apparatus 100*f* and back again, forming a loop. Thus, each apparatus 100 would have at least two "sections" of the conductive conduit 120. Further, in some embodiments, each conductive conduit 120 of the apparatus 100 has two "ports" on each end 102, 104, in which one set is for fluid input (or downflow) and one set of fluid output (or uptake). In other embodiments, the conductive conduit 120 of the apparatus 100 forms a heat pipe.

The conductive conduit 120 through each apparatus 100 includes a fluid input section 126 that forms the spiral shape. The spiral shape increases the overall surface area and, thus, heat transfer between the conductive conduit 120 and the thermal transition zone 112. The conductive conduit 120 further includes a fluid output section 128 that is substantially linear through each apparatus 100. The configuration may be reversed in some embodiments. The linear section provides a quick path for the cooled or heated fluid—whichever is preferred in that heat exchange scenario—to return to the heat exchanger assembly 20.

In other implementations, the conductive conduit 120 may include a double-spiral shape, including one spiral section for the downflow or fluid input section and another spiral section for the uptake or fluid output. The two spiral sections may be interspaced with each other or offset radially from each other. In other implementations, a spiral with a lower or higher pitch is used. In other implementations, a non-spiral geometry is provided (e.g., an irregular pattern or a wave-like pattern).

In yet other implementations, multiple conductive conduit 120 may be employed in the respective apparatus for the fluid flow.

In FIG. 1A, the lowermost apparatus (e.g., the apparatus 100*f* in FIG. 1A) is distinct from the other apparatuses 100 to provide a transition of the conductive conduit 120*f* to a return loop. This section 129 of the conductive conduit 120 represents the transition from the fluid input section 126 to the fluid output section 128. Rather than extending from the first end 102 to the second end 104, the conductive conduit 120*f* spirals around the central channel 110 towards the second end 104 and turns back towards the first end 102. Thus, the apparatus 100*f* does not include a fluid/conduit port or coupling on the lowermost second end 102.

In the example shown in FIG. 1A, the heat exchanger assembly 20 includes a pump 21 in fluid communication with the conductive conduit 120 to urge fluid through the conductive conduit 120 of the ETTZ energy pile 30*a*. The heat exchanger assembly 20 further includes a heat exchanger 22 housing and thermal communication with a portion of the conductive conduit 120. The heat exchanger 22 additionally houses and is in thermal communication with a secondary fluid conduit 23. For example, the secondary fluid conduit 23 may contain a refrigerant for use in an HVAC system or a water/coolant line for use in an energy system of a building. A second pump 24 is disposed along the secondary fluid conduit 23 to urge secondary fluid along the secondary fluid conduit 23.

A sensor 25 is also included adjacent to the heat exchanger 22. The sensor 25 may be one or more sensors configured to monitor the heat transfer between the conductive conduit 120 and the secondary fluid of the secondary fluid conduit 23. For example, the sensor 25 may include temperature sensor(s), pressure sensor(s), and or flow sensor (s).

The heat exchanger assembly 20 further includes a controller 26 in electrical communication with the other elements of the heat exchanger assembly 20. The controller 26 is configured to control operation of at least the pump 21, the heat exchanger 22, and the second pump 24. For example, the controller 26 may activate, deactivate, or adjust any one of the elements of the heat exchanger assembly 20 in response to values received from the sensor 25.

In use, the ETTZ energy pile 30*a* of apparatuses 100 is installed in the substrate 40 (e.g., underneath a building or other structure). In some implementations, a structural pile (e.g., a concrete pile) is further installed in the substrate 40 (e.g., in the central channel 110 of the apparatuses 100). The conductive conduit 120 is coupled to the heat exchanger assembly 20, including the pump 21 and the heat exchanger 22. Additionally, a system of the building (e.g., an HVAC system or an energy system) is coupled to the heat exchanger 22 via the secondary fluid conduit 23.

The ETTZ energy pile 30*a* and the heat exchanger assembly 20 coupled thereto may be used to dissipate heat from a system of the building or to collect heat from the substrate 40. A fluid is urged along the fluid input section 126 conductive conduit 120 via pump 21, the fluid spiraling through each apparatus 100 of the pile 30*a*. While in the thermal transition zone 112 of each apparatus 100, the conductive conduit 120 dissipates heat into the thermal transition zone 112, out through the outer surface 106, and in substrate 40 (or collects heat in the opposite direction). Once the fluid reaches the apparatus 100*f*, the fluid in the conductive conduit 120 flows back up through the fluid output section 128 of the conductive conduit 120 and into the heat exchanger 22.

Heat pipe configuration. FIG. 1B shows a diagram of a system 10*b* that is substantially similar to the system 10*a* of FIG. 1A, except as described below. In FIG. 1B, the conductive conduit 120 is configured as a heat pipe. As a heat-transfer device, the heat pipe employs phase transition to transfer heat between the ETTZ 112 and the heat exchanger assembly 20 (shown as 20').

At the hot interface of a heat pipe along the conductive conduit 120, a liquid in contact with a thermally conductive solid surface turns into a vapor by absorbing heat from that surface. The vapor then travels along the heat pipe to the cold interface at the heat exchanger assembly 20' and condenses back into a liquid, releasing the latent heat. The liquid then returns to the hot interface by gravity and the cycle repeats.

Thermal Performance of Engineered Thermal Transition Zone

Figure 2A:
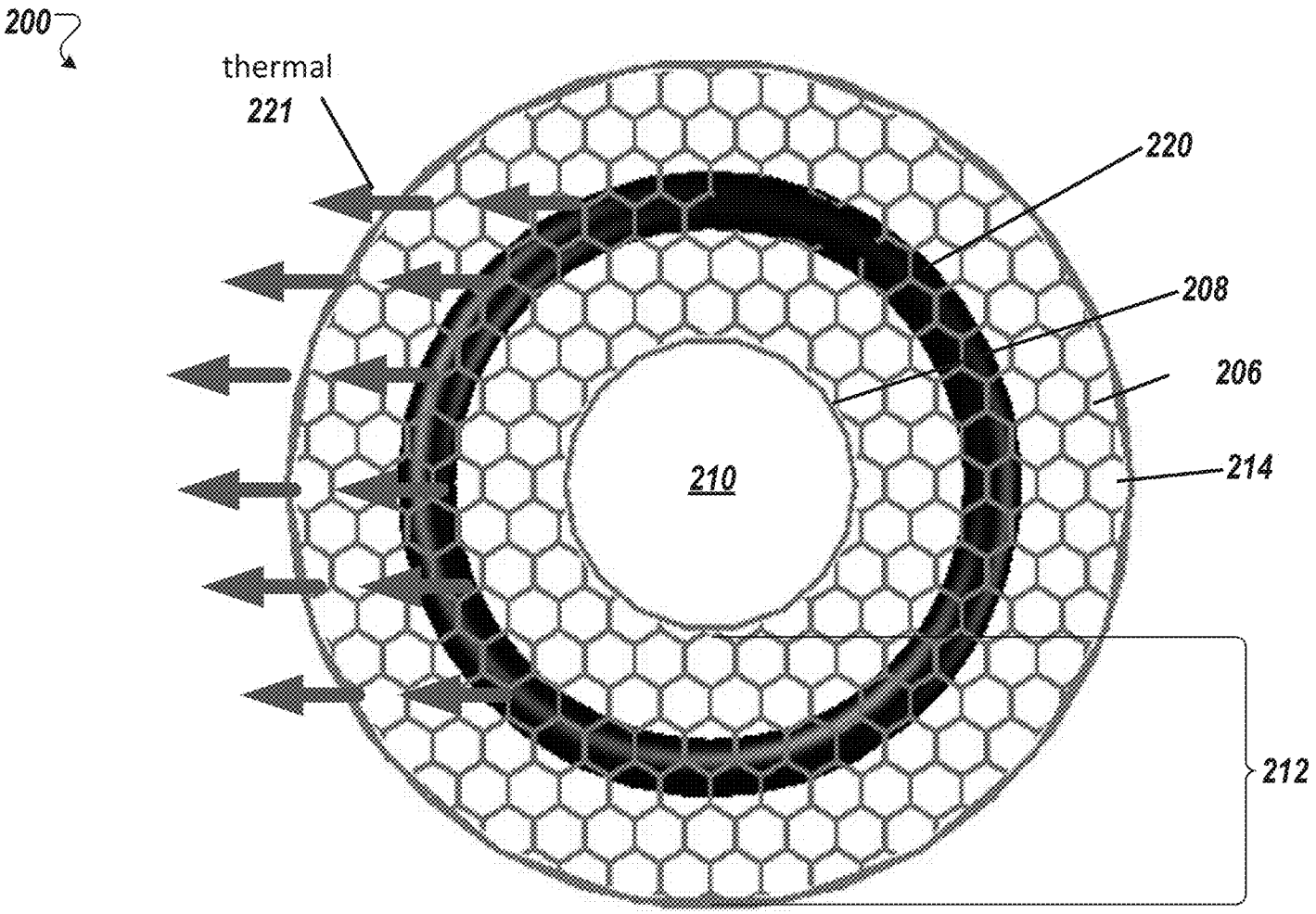
FIGS. 2A and 2B each show an example of the engineered thermal transition zone by the ETTZ energy pile sections of FIGS. 1A and 1B in accordance with various illustrative embodiments.
Figure 2B:
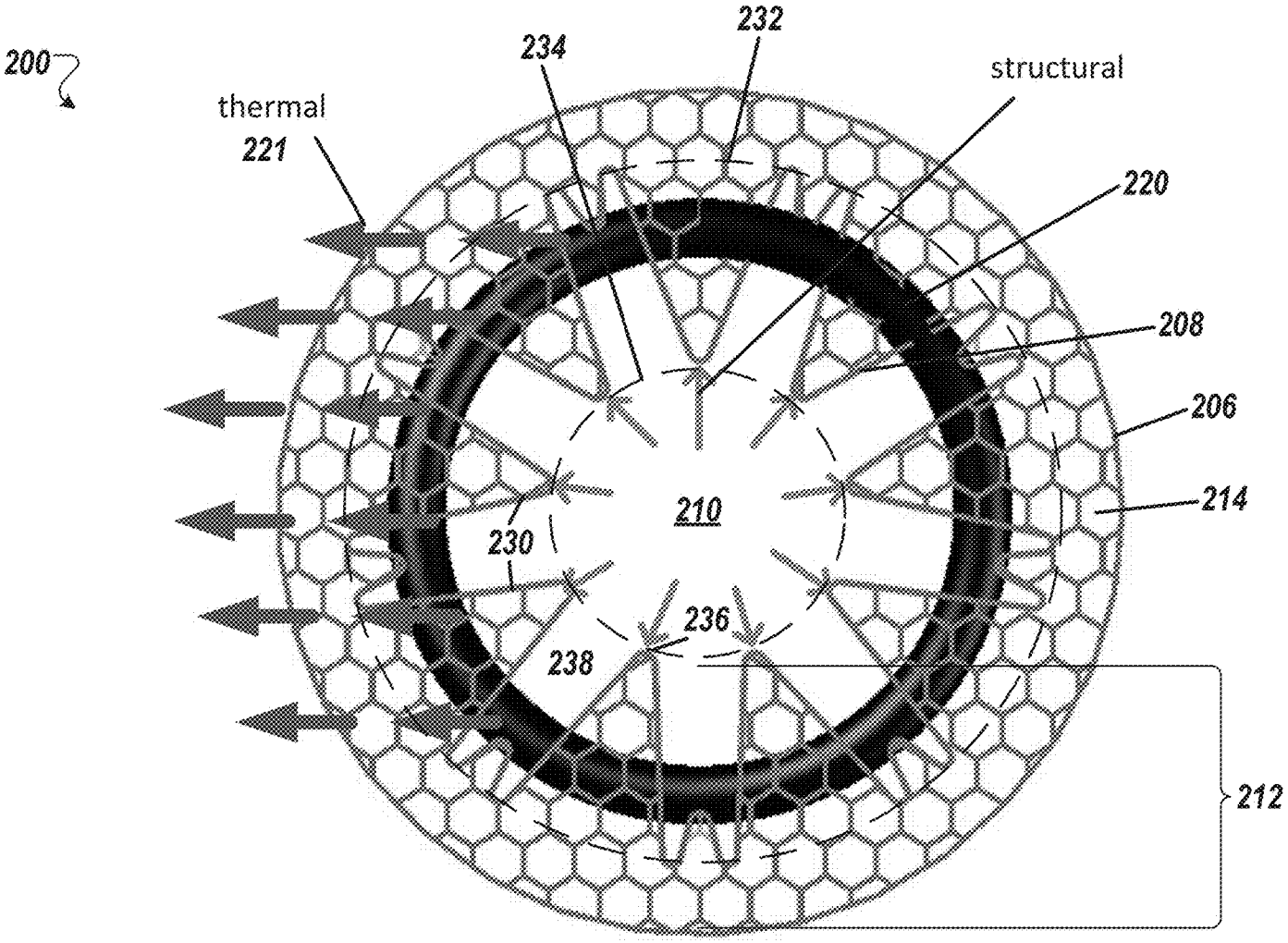

FIGS. 2A and 2B each show an example of the engineered thermal transition zone 112 by an apparatus 100 (shown as 200*a*, 200*b*). In FIG. 2A, a cross-section of an apparatus 200*a* is shown that is substantially similar to the apparatus 100 in FIG. 1A, except as described below. FIG. 2B shows an ETTZ 112 having shapes inspired by roots and plant xylem.

In each of FIGS. 2A and 2B, the apparatus 200*a*, 200*b* includes an outer surface 206 (previously referred to as 106) that ends between the first end 102 and the second end 104 of the apparatus 200. An inner surface 208 (previously referred to as 108) is spaced apart and radially inward of the outer surface 206.

In FIG. 2B, the inner surface 208 includes a pattern of radial projections 230. The inner surface 208 and the pattern of radial projections 230 define interstitial spaces 238 defined each of the radial projections 230. The radial projections 230 and the interstitial spaces 238 together define a first circumference 232 and a second circumference 234 radially inward from the first circumference 232. The second circumference 234, coinciding with the inner tips 236 of the radial projections 230, defines the central channel 210 of the apparatus 200.

Referring to FIG. 2A (as well as 2B), the engineered thermal transition zone 212 (previously referred to as 112) extends between the inner surface 208 and the outer surface 206. The thermal transition zone 212 includes a plurality of cells 214 that are hexagonal shaped, similar to the plurality of cells 114 of the apparatus 100.

A conductive conduit 220 (previously referred to as 120) is disposed between the outer surface 206 and the first circumference 232 of the inner surface 208. The conductive conduit 220 extends through a portion of the thermal transition zone 212 in FIG. 2A, and additionally through portions of the radial projections 230 of the inner surface 208 in FIG. 2B. In other implementations, the conductive conduit may be disposed further radially inward or outward such that a greater or lesser portion of the conductive conduit 220 is exposed to the central channel 210.

The arrows 221 on the left of FIGS. 2A and 2B and extending from the conductive conduit 220 and through the thermal transition zone 212 and the outer surface 206 represent the thermal transfer facilitated by the apparatus 200*a*, 200*b*. As shown, e.g., when the temperature of the fluid in the conductive conduit 220 is higher than the temperature of the surrounding soil, heat is exiting the conductive conduit 220 into the thermal transition zone 212, which is then transmitted the surrounding soil (e.g., substrate 40). And, when the temperature of the fluid in the conductive conduit 220 is lower than the temperature of the surrounding soil, heat is drawn from the surrounding substrate and back into the conductive conduit 220 through the ETTZ 212.

The governing thermal equation for heat transfer through the fluid circulation pipes can be expressed as Equation 1.

$$\frac{\partial T}{\partial t} = \frac{k\nabla^2 T}{\rho C_v} - \vec{u}\cdot\nabla T + \frac{f_D\cdot|\vec{u}|^3}{C_v\, 2d_h} + \frac{Q_{wall}}{\rho A C_v} + \frac{q_v^T}{\rho C_v} + \frac{Q_p}{\rho A C_v} \quad \text{(Eq. 1)}$$

In Equation 1, k is the thermal conductivity constant (W/m–K), T is the temperature (K) of the coolant, ρ is the mass density (kg/m$^3$) of the coolant, $C_v$=specific heat capacity (J/kg–K) of the coolant, $\vec{u}$ is the fluid velocity field (m/s) for the coolant, $f_D$ is the Darcy friction factor (dimensionless), $d_h$ is the mean hydraulic diameter of the pipe (m), $Q_{wall}$=hZ($T_{ext}$–T) is the heat transfer through the pipe wall (W/m), h is the heat transfer coefficient (W/m$^2$–K) for the conductive conduit, Z is the pipe wall perimeter (m) for the conductive conduit, $T_{ext}$ is the external temperature outside the conductive conduit (K), e.g., the ETTZ, A is the pipe cross-sectional area (m$^2$) for the conductive conduit, $$q_v^T$$

is the volumetric heat source intensity (W/m$^3$), and $Q_p$ is the pressure work (W/m).

The conductive heat transfer through the ETTZ and the surrounding geomaterials can be expressed as Equation 2.

$$\frac{\partial T}{\partial t} = \alpha\nabla^2 T \quad \text{(Eq. 2)}$$

In Equation 2, a is the thermal diffusivity where α=k/(ρ$C_v$), k is the thermal conductivity of the medium (W/m–K), ρ=mass density (kg/m$^3$), and $C_v$=specific heat capacity (J/kg–K).

As discussed in apparatus 100 in relation to FIG. 1A, the apparatus 200 may be filled with aggregate or a flowable fill material to increase the overall thermal conductivity of the thermal transition zone 212. For example, an aggregate or a flowable fill material (e.g., grout or other material which may include pond fines, coarse rock, medium rock, concrete, or other aggregate material enhanced with a conductive material or quarry by-product or engineered material) may be disposed within the plurality of cells 214. Additionally, a material may be disposed within the central channel 210 (e.g., surrounding a structural pile) and the adjacent spaces 238 defined by the radial projections 230. The enhanced filler material increases the heat transfer efficiency between the surrounding substrate and the conductive conduit 220.

Quarry pond fines are by-products of mining operations that currently have limited usage and can be utilized as filling material for the ETTZ. Pond fines refer to the fines obtained from the washing of a crushed stone aggregate. During production, the coarser size range (greater than No. 30 sieve) from washing may be recovered by means of a sand screw classifier.

In FIG. 2B, in particular, the radial projections 230 also provide structural support and stability to the apparatus 200.

For example, similar to the xylem structure of a plant stem, the radial projections 230 in conjunction with the plurality of cells 214 create a strong supportive structure of the apparatus 200. As shown, the inner tips 236 of the radial projections 230 define the central channel 210 through which a structural pile may be installed. Thus, the inner tips 236 may abut and support a structural pile installed in the central channel 210. The arrows shown in the central channel 210 adjacent to the inner tips 236 represent the structural forces provided by the apparatus 200. In other implementations, the inner surface includes a different number of projections and/or a different geometrical pattern of projections. In some examples, the projections of the inner surface meet at a central point.

Example ETTZ Energy Pile Sections

Figure 3A:
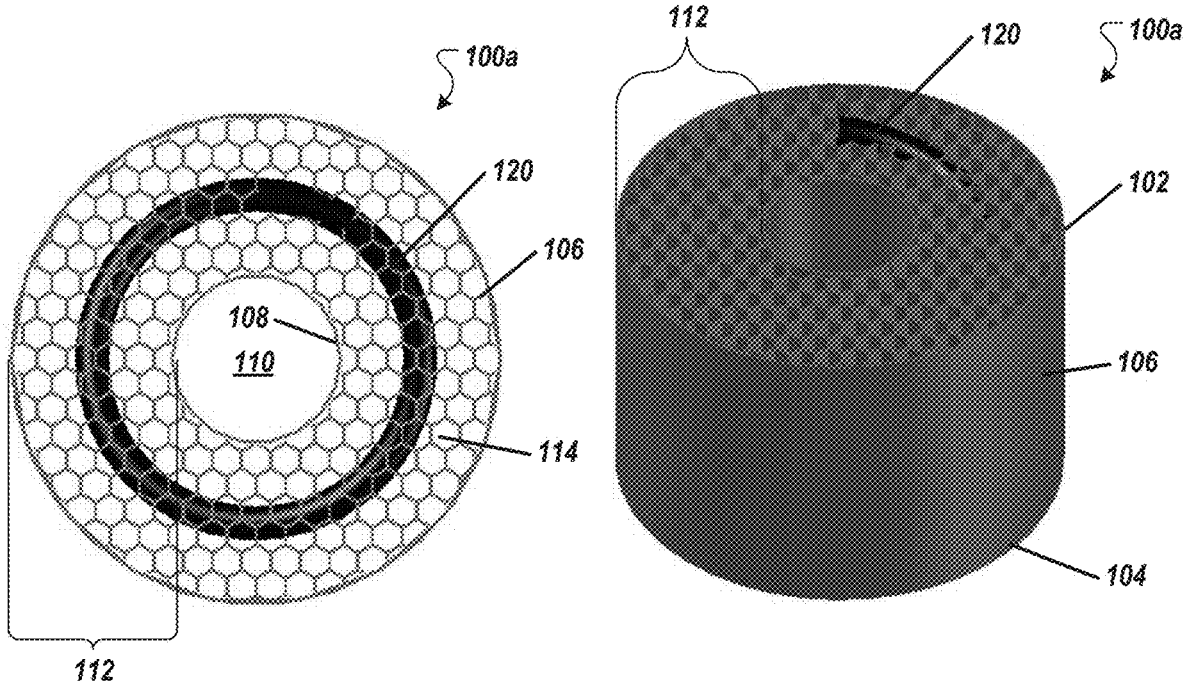

FIGS. 3A-3F show examples of ETTZ energy pile sections as apparatuses 100 (shown as 100*a*, 100*b*, 100*c*, 100*d*). Specifically, FIG. 3A shows another view of the apparatus 100 shown in FIG. 1A, along with the corresponding cross-section. As shown, the apparatus includes the plurality of cells 114 comprised of hexagons. The inner surface 108 is circular, matching the circular outer surface 106. However, the pattern of cells in the thermal transition zone and the shape of the inner surface of the apparatus disclosed herein have other implementations.

Figure 3B:
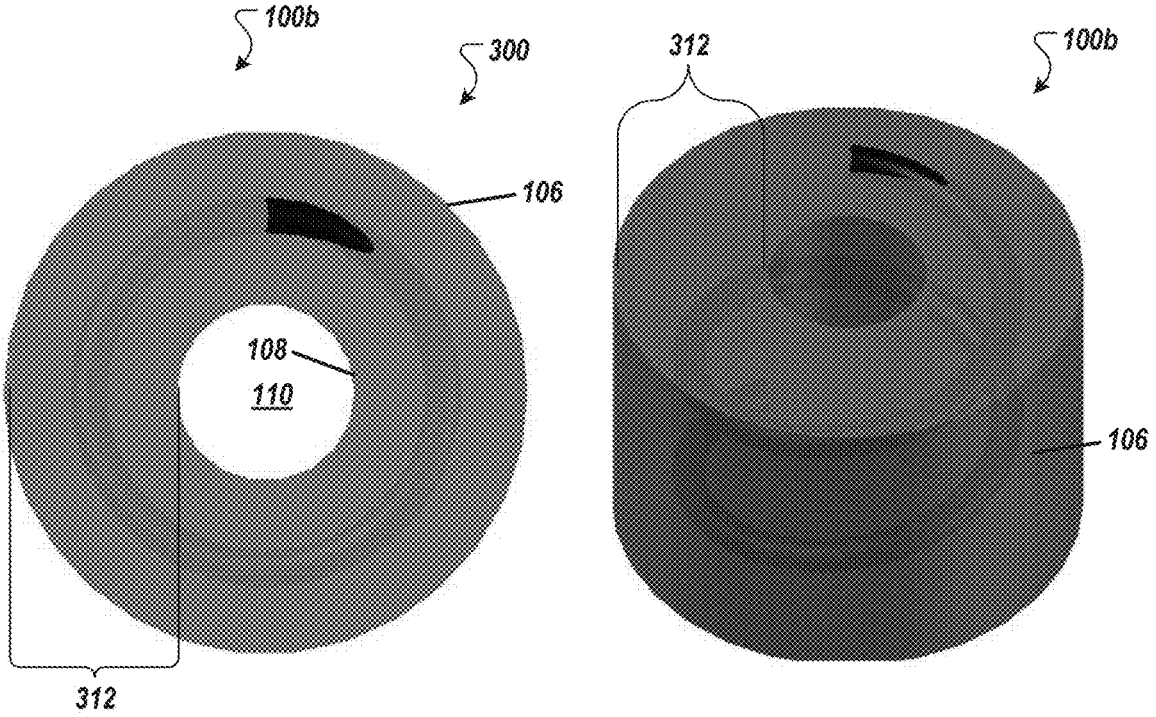

FIG. 3B shows an apparatus 300 that is substantially similar to the apparatus 100 of FIGS. 1A and 3A, except as described below. The apparatus 300 includes a circular inner surface 108, similar to the apparatus 100. However, the thermal transition zone 312 of the apparatus 300 is a solid material without a plurality of cells. The conductive conduit 320 of the apparatus extends directly through the solid thermal transition zone 312. The solid material of the thermal transition zone 312 may be formed from a plastic or composite material. The solid material includes a thermal conductivity greater than that of the surrounding substrate.

Figure 3C:
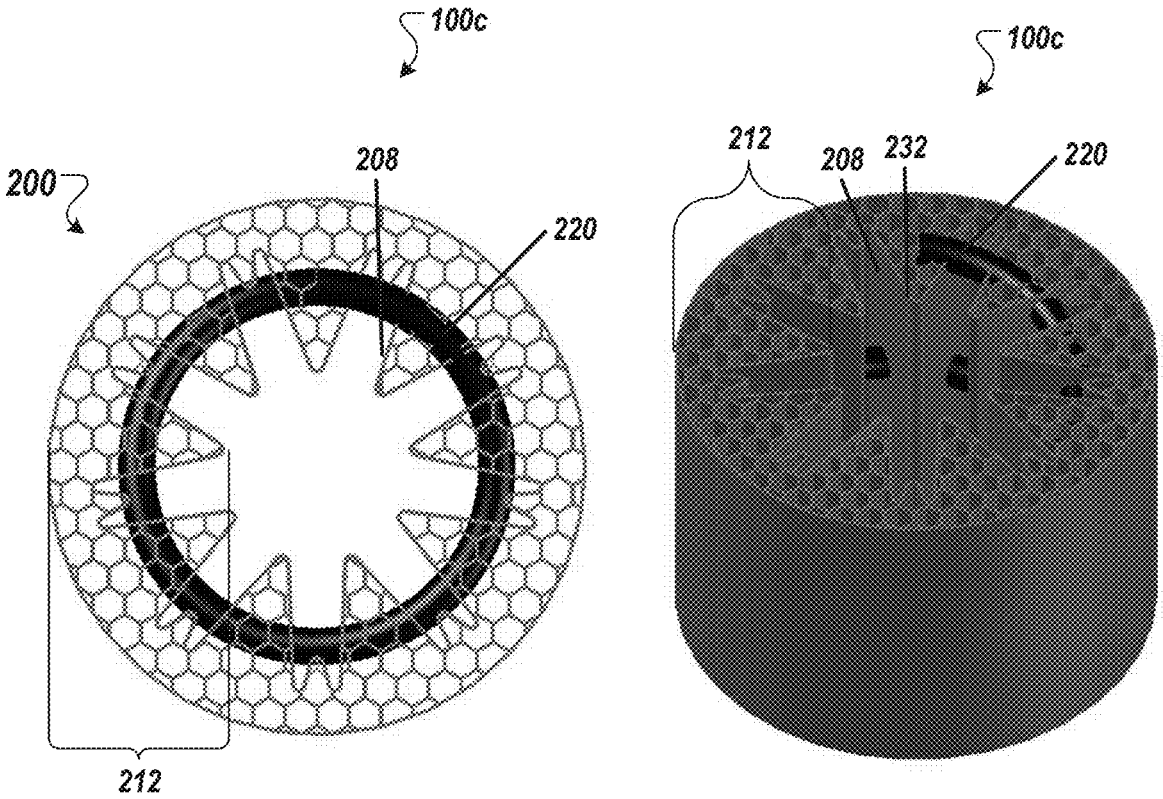

FIG. 3C shows another view of the apparatus 200 of FIG. 2B, including the cross-section and a corresponding isometric view. The isometric view shows the conductive conduit 220 extending through the inner surface 208, defining the radial projections 230.

Figure 3D:
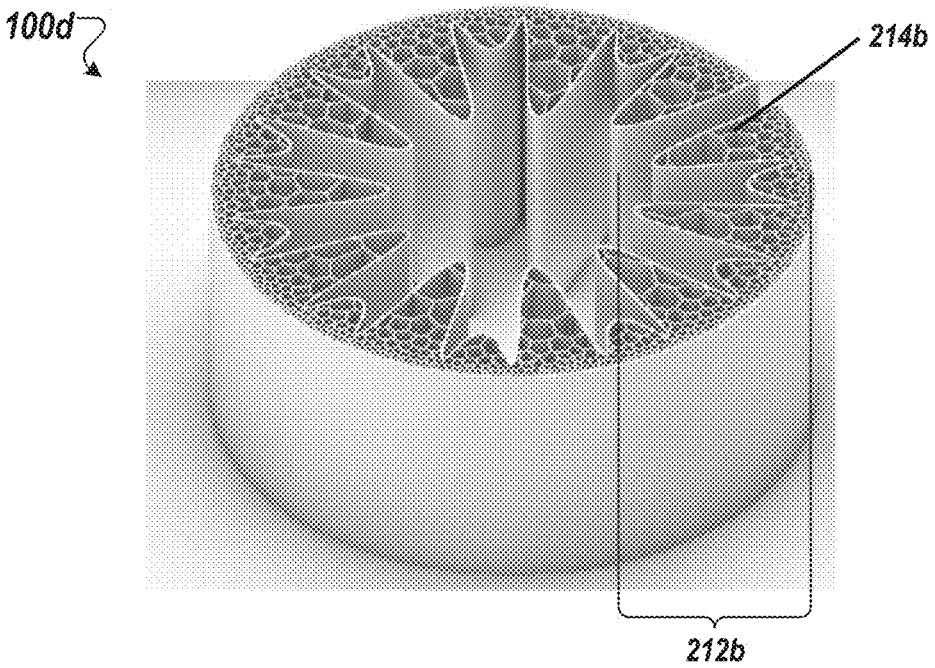

FIG. 3D shows an apparatus 100*d* having an overall structure similar to the apparatus 200 of FIG. 3C. However, the apparatus 100*d* does not show the conductive conduit. In some implementations, at least a portion of the thermal transition zone 212*b* and the plurality of cells 214*b* therein are used for fluid transport up and down the apparatus 100*d*. In other implementations, a conductive conduit as elsewhere described, is disposed within the thermal transition zone 212*b* of the apparatus 100*d*.

The apparatus 100*d* includes a plurality of cells 214*b* having different and non-uniform sizes and shapes. The structure of the thermal transition zone 212*b* is a bio-inspired structure resembling a xylem structure in a plant stem. In a plant, the xylem serves as the primary water-conducting tissue responsible for transporting water and dissolved minerals from the roots to the rest of the plant, including the leaves and flowers. The structural components of the xylem structure, such as vessel elements and tracheid, form a continuous network that acts like a pipeline and allows water to move upwards through the stem. This efficient water transport system in the xylem structure is essential for maintaining the plant's hydration, supporting its growth, and ensuring its overall health and survival.

The network of cells and channels formed by the plant stem's xylem structure can be used to form the structure of engineered components, such as energy piles (e.g., the apparatus 100*d* of FIG. 3D). The shape of the plant stem's inner network provides substantial rigidity while allowing for fluid flow up and down the stem. Similarly, a thermal transition zone coupled to an energy pile can provide for efficient fluid transport (e.g., in a geothermal heat exchange system) while providing sufficient rigidity.

Figure 3F:
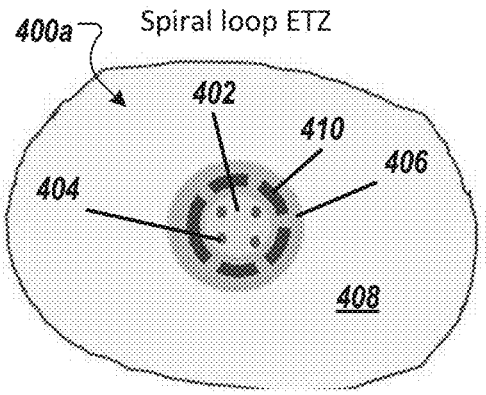

FIG. 3F shows a cross-section of an apparatus 400*a* showing a spiral loop ETTZ energy pile. The apparatus 400*a* includes a structural pile 402 having reinforcement members 404 (e.g., a reinforced concrete pile). The structure pile 402 is surrounded by an engineered thermal transition zone 406 that includes a material having a thermal conductivity greater than that of the surrounding substrate 408. A conductive conduit 410 spirals around the structural pile 402 within the thermal transition zone 406. Each of FIGS. 3G-3I may also include a conductive conduit in other implementations. The structural pile 402 in FIG. 3F (and elsewhere described) will have an outer diameter smaller than at least a portion of the ETTZ apparatus surrounding it (e.g., the apparatus 400*a*). In some implementations, the diameter of the structural pile is in the range of 6 inches to 48 inches, and the diameter of the ETTZ apparatus is in the range of 8 inches to 10 feet. In some implementations, the ratio of the diameter of the ETTZ apparatus to the diameter structural pile disposed therein is in the range of 20:1 to 1:1.25 (e.g., 20:1, 15:1, 10:1, 8:1, 6:1, 4:1, 3:1, 2.5:1, 2:1, 1.5:1, or 1.25:1).

Figure 3G:
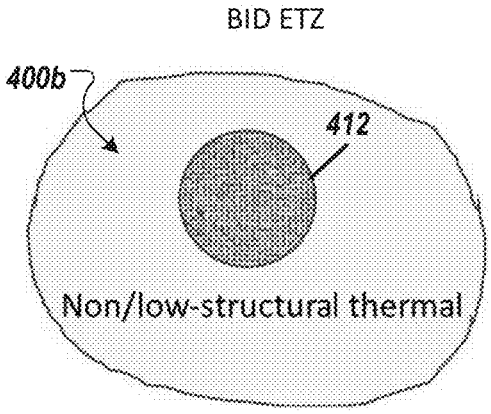

FIG. 3G shows a cross-section of an apparatus 400*b* showing a structural/thermal pile 412. The ETTZ energy pile 412 provides both structural support (e.g., via a pattern of cells and surfaces interior to the pile 412) and heat transfer (e.g., via a material with higher thermal conductivity than the surrounding substrate). The apparatus 400*b* may be used in thermal-only systems or in systems where a concrete pile is not necessary (e.g., relatively light structures).

Figure 3H:
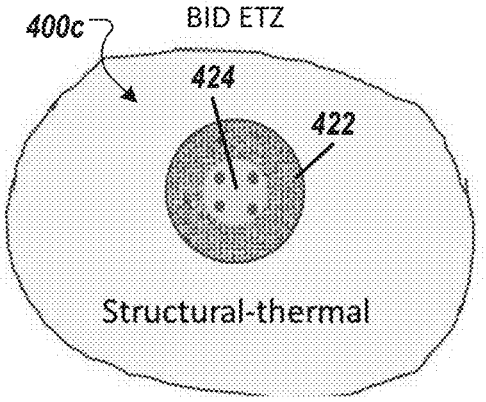

FIG. 3H shows a cross-section of an apparatus 400*c* having an engineered thermal transition zone 422 surrounding a structural pile 424. The engineered thermal transition zone 422 provides both structural support and heat transfer (e.g., via a material with higher thermal conductivity than the surrounding substrate). The structural support is provided in part by a pattern of cells and surfaces interior to the engineered thermal transition zone 424 of the apparatus 400*c*, and furthermore by the structural pile 424 (e.g., a reinforced concrete pile) interior to the thermal transition zone 422.

Figure 3I:
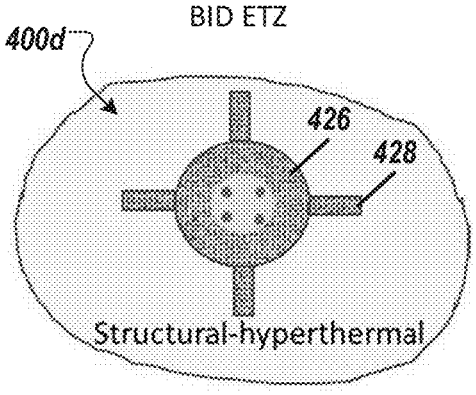

FIG. 3I shows a cross-section of an apparatus 400*d* that is substantially similar to the apparatus 400*c*, except as described below. The engineered thermal transition zone 426 of the apparatus 400*d* includes projections 428 to further enhance the heat transfer ability of the engineered thermal transition zone 426.

Example Engineered Thermal Transition Zone Configurations

Figure 4A:
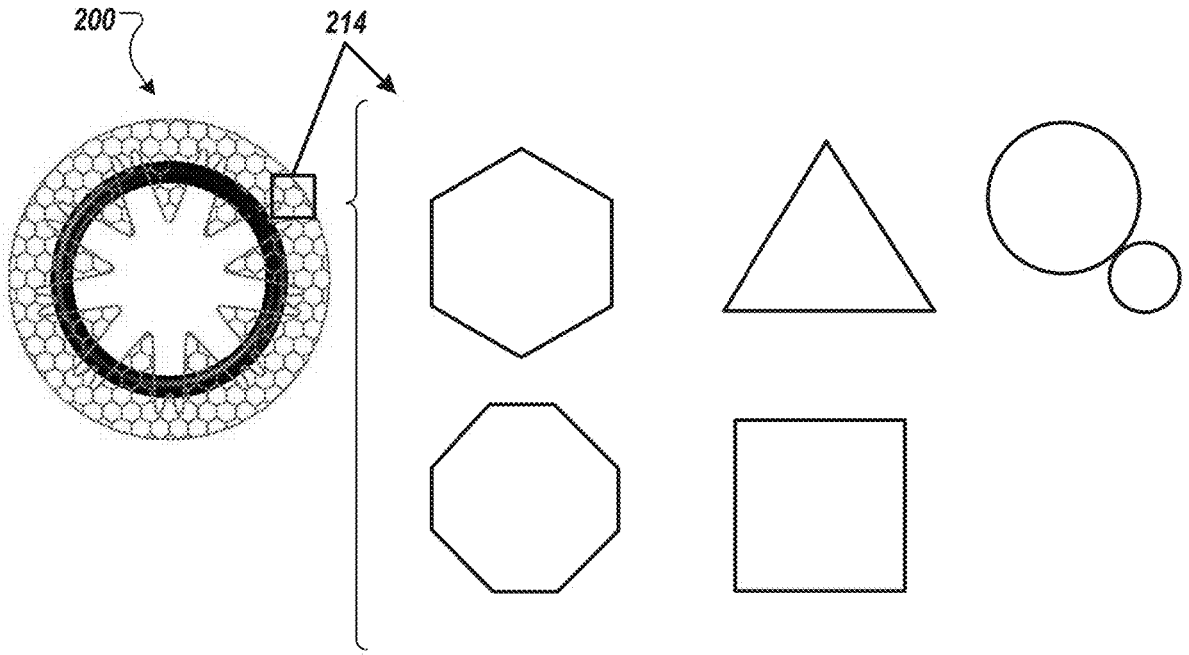
FIG. 4A shows example configurations of the structures in the engineered thermal transition zone in accordance with an illustrative embodiment.

Example ETTZ Unit cell. FIG. 4A shows another view of the cross-section of the apparatus 200 that includes the plurality of cells 214 forming a patterned network of cells in the thermal transition zone 212. As shown, the plurality of cells 214 in the apparatus 200 are hexagonal in shape, forming a honeycomb structure between the inner surface 208 and the outer surface 206. The pattern of networked cells interior to the apparatus 200 provides strength to the apparatus 200 while making efficient use of the materials used in the manufacturing process. The networked cells also provide spaces within which the flowable fill material (e.g., the enhanced thermal flowable fill material, grout, or pond fines) may be deposited to fill the network of cells.

However, the pattern of networked cells forming the interior of the apparatus 200 may include a variety of shapes other than the hexagonal/honeycomb structure. For example, as shown in FIG. 4A, the plurality of cells may have a triangular shape, a circular shape, an octagonal shape, or a square shape. In other implementations, other regular and irregular polygon shapes may be used in the plurality of cells.

Each of the plurality of cells may be the same size or a different size (e.g., as in the circles shown in FIG. 4A). The inner space defined by each cell may be larger closer to the outer surface, larger closer to the inner surface, or randomly dispersed throughout the thermal transition zone. In other implementations, different shapes of cells may be included in a patterned network of cells (e.g., a tessellation pattern comprising a mixture of triangles and hexagons, a mixture of trapezoids and hexagons, etc.).

Figure 4B:
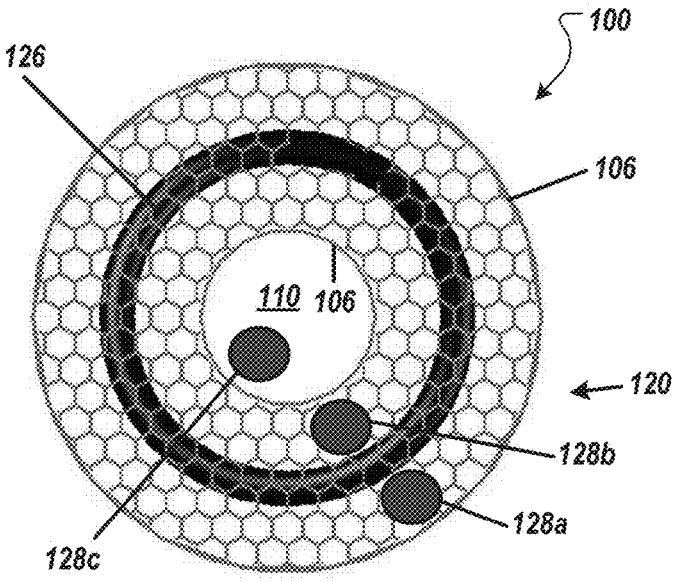
FIGS. 4B, 4C, and 4D each show example configurations of the conductive conduit structures and return conduit in the engineered thermal transition zone in accordance with various illustrative embodiments.

Return pipe configurations. FIG. 4B shows a cross-section of the apparatus 100 with both sections of the conductive conduit 120 shown. Specifically, the fluid output section 128 that spirals around the central channel 110 is shown within the honeycomb network of cells 114 of the thermal transition zone 112. As shown, the spiral fluid output section 128 of the conductive conduit 120 is positioned midway between the outer surface 106 and the inner surface 108. However, other positions of the conductive conduit 120 are contemplated by this disclosure, and FIG. 4B is one example only. In other implementations, the spiral fluid output section 128 may be radially closer to the outer surface 106, radially closer to the inner surface 108, or offset from being symmetrical with the central channel 110.

The fluid output section 128 of the apparatus 100 is a linear section extending substantially parallel to a central axis of the central channel 110. As described above, the linear fluid output section 128 ensures that the fluid with the highest temperature difference is delivered to a coupled heat exchange assembly above ground as quickly as possible.

FIG. 4B includes three different example positions of the fluid output section 128. In one example, the fluid output section 128*a* is positioned between the fluid input section 126 and the outer surface 106. In another example, the fluid output section 128*b* is positioned between the fluid input section 126 and the inner surface 108. In another example, the fluid output section 128*c* is positioned within the central channel 110, radially inside of the inner surface 108. In one implementation, the fluid output section 128*c* may be used in examples wherein a reinforced concrete pile is not installed within the central channel 110 and the apparatus 100 provides sufficient structural support. In other implementations, the fluid output section 128*c* is used when the reinforce concrete pile is installed within the apparatus 100 and extends through the concrete pile.

Figure 4C:
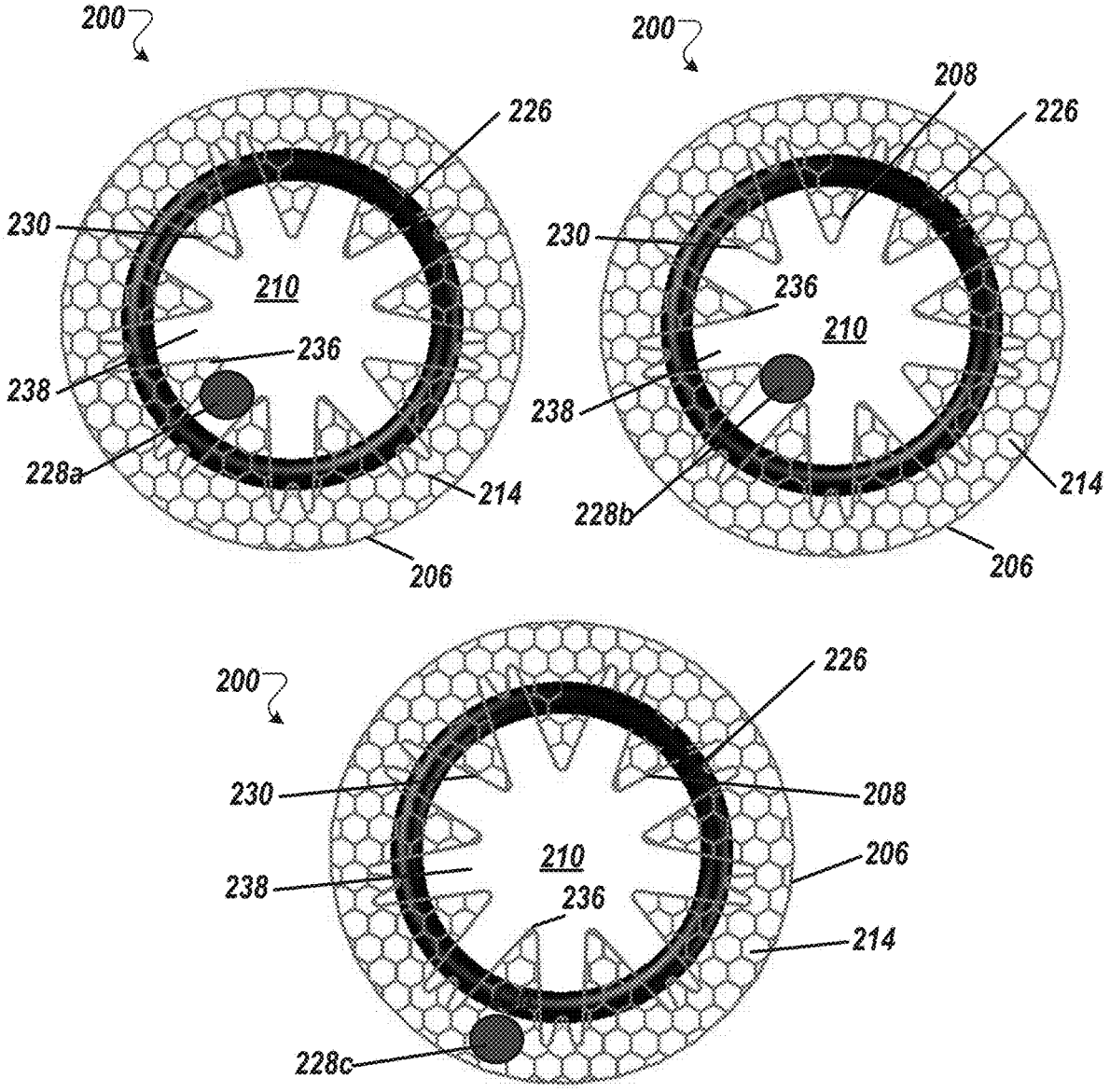

FIG. 4C shows a diagram similar to that of FIG. 4B displaying alternate positions of the conductive conduit 220. However, FIG. 4C shows the apparatus 200 having the radial projections 230 and interstitial spaces 238 defined by the inner surface 208. Again, the conductive conduit 220 includes a fluid input section 226 spiraling around the central channel 210 and a fluid output section 228 that is substantially linear and parallel to a central axis of the central channel 210.

In one example, the fluid output section 228*a* is disposed between the fluid input section 226 and the central channel 210 (e.g., radially outward from the inner tips 236 of the radial projections 230, but radially inward from the fluid input section 226). In another example, the fluid output section 228*b* is disposed radially inward from the fluid input section 226 and at least partially radially inward from inner tips 236 of the radial projections 230 (e.g., being supported at least partially by the inner tips 236 of the radial projections 230).

In another example, the fluid output section 228*c* is disposed radially outward from fluid input section 226 and radially inward from the outer surface 206. The fluid output section 228*c* is surrounded by the patterned, honeycomb network of the plurality of cells 214. As elsewhere described, the fluid output section 228 may be disposed in a different arrangement or position than the examples shown in FIG. 4C.

The conductive conduits described in this disclosure may include a variety of shapes and/or geometric patterns. For example, depending on the heat transfer characteristics of the apparatus, the enhanced filler material, the surrounding substrate, and the heat exchange assembly, the conductive conduit (e.g., the conductive conduit 120 or the conductive conduit 220 or other examples shown and described herein) may have a different geometry.

Figure 4D:
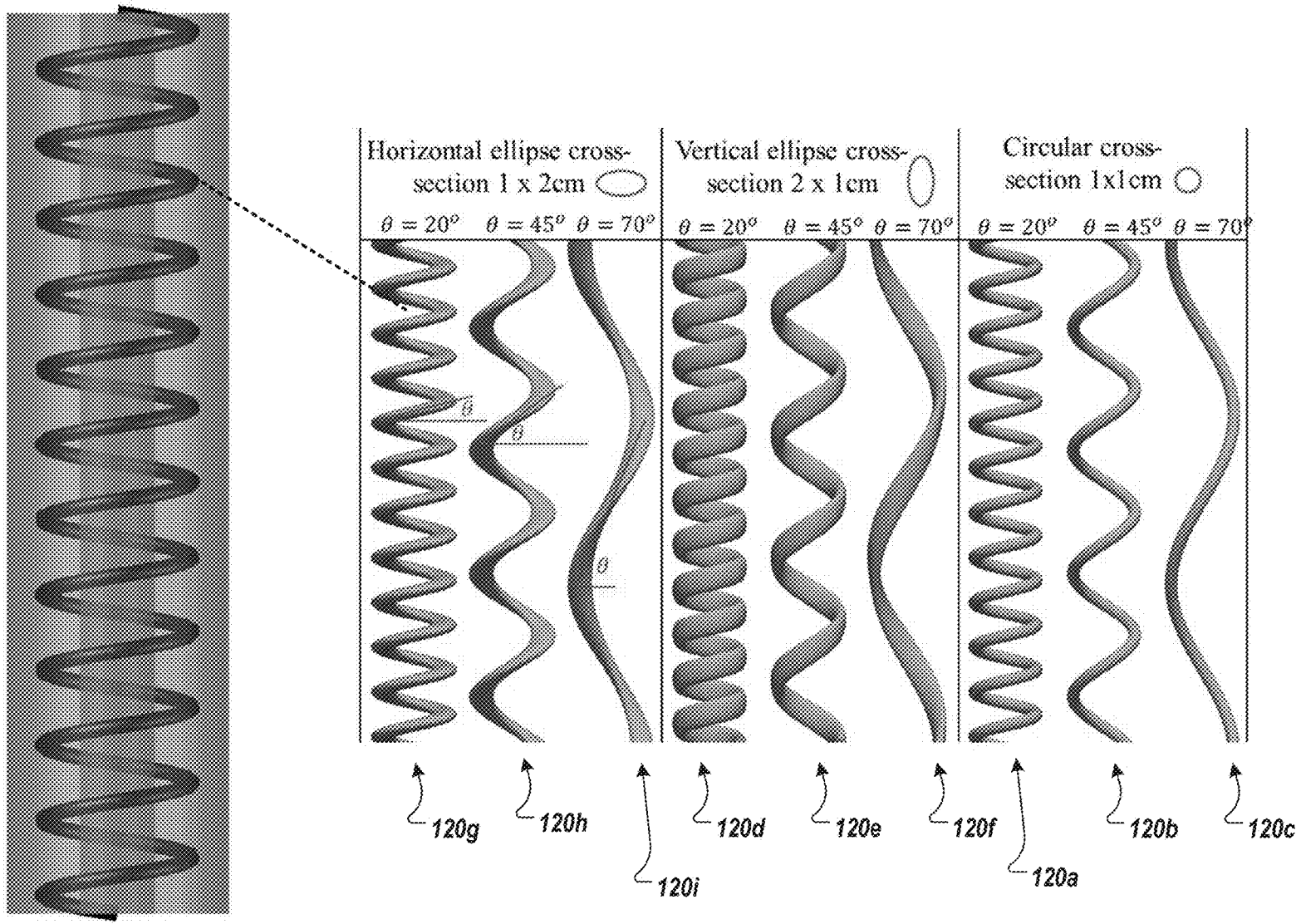

Example Conductive Conduit Configurations. FIG. 4D shows a variety of example shapes and patterns for a conductive conduit 120 disposed within the apparatus (e.g., 100). The diagram of conductive conduit implementations is shown in FIG. 4D displays variations in (i) the cross section and (ii) the pitch angle of a spiral conduit. In general, decreasing the pitch angle of the spiral conduit increases the density of the conductive conduit 120, extending through the thermal transition zone 112. Thus, a decreased pitch angle generally provides increased fluid flow time and, thus, heat transfer capacity. In general, increasing the surface area of the conductive conduit 120 (e.g., the circumference of the cross-section) also increases the heat transfer capacity. However, the directionality of the cross-section also contributes to the heat transfer capacity.

The conductive conduit 120*a* in FIG. 4D has a circular cross-section with a 1×1 cm footprint (e.g., a 1 cm diameter). Similarly, the conductive conduit 120*b* and the conductive conduit 120*c* also have a circular cross section with a 1×1 cm footprint (e.g., a 1 cm diameter). However, these dimensions are exemplary only. Throughout this disclosure, dimensions shown in the figures or described herein are exemplary only and are not meant to limit the scope of the disclosure.

The conductive conduit 120*a* in FIG. 4D has spiral shape with a pitch angle "θ" of 20°. The conductive conduit 120*b* has a spiral shape with a pitch angle "θ" of 45°. The conductive conduit 120*c* has a spiral shape with a pitch angle "θ" of 70°. Therefore, in general, the conductive conduit 120*c* should have a lower heat transfer capacity than the conductive conduit 120*b* and the conductive conduit 120*c* due to the lower density of the conductive conduit per unit length.

Similarly, the conductive conduit 120*d* and the conductive conduit 120*g* are shown in FIG. 4D has a spiral shape with a pitch angle "θ" of 20°. The conductive conduit 120*e* and the conductive conduit 120*h* are shown in FIG. 4D has a spiral shape with a pitch angle "θ" of 45°. The conductive conduit 120*f* and the conductive conduit 120*i* are shown in FIG. 4D has a spiral shape with a pitch angle "θ" of 70°. Thus, similar to the conductive conduit 120*c*, each of the conductive conduit 120*f* and the conductive conduit 120*i* normally have a lower heat transfer capacity than the corresponding conduits having a lower pitch angle. In other implementations, a pitch angle greater than or less than that shown in FIG. 4D is contemplated by this disclosure (e.g., a pitch angle in the range of) 5-85°.

The conductive conduits 120*d*, 120*c*, and 120*f* have an elliptical cross-section having a 2×1 cm cross-section (e.g., a 2 cm by 1 cm footprint). The elliptical cross-section of the conductive conduits 120*d*, 120*c*, and 120*f* is a vertical ellipse oriented such that the longitudinal axis of the ellipse is aligned substantially parallel with the longitudinal axis of the apparatus 100. As shown in FIG. 4D, the vertical ellipse orientation creates a larger outward-facing surface area of the conductive conduit 120*d* (e.g., more surface area directed in the radial direction of the apparatus 100).

The conductive conduits 120*g*, 120*h*, and 120*i* have an elliptical cross section having a 1×2 cm cross section (e.g., a 1 cm by 2 cm footprint). The elliptical cross section of the conductive conduits 120*g*, 120*h*, and 120*i* is a horizontal ellipse oriented such that the longitudinal axis of the ellipse is allied substantially perpendicular to the longitudinal axis of the apparatus 100. As shown in FIG. 4D, the horizontal ellipse orientation creates a larger upward-facing surface area of the conductive conduit 120*g* (e.g., more surface area directed in the longitudinal direction of the apparatus 100).

As elsewhere described, each "apparatus" (e.g., the apparatus 100 in FIG. 1A and FIG. 3A) may be combined with additional apparatuses to form a pile (e.g., the ETTZ energy pile 30*a* of FIG. 1A). Thus, each "apparatus" can be a unit cell/section of the pile, repeating the same pattern over and over again for a given length of the pile. The characteristics of the unit cell contribute to the overall characteristics of the pile.

Figure 4E:
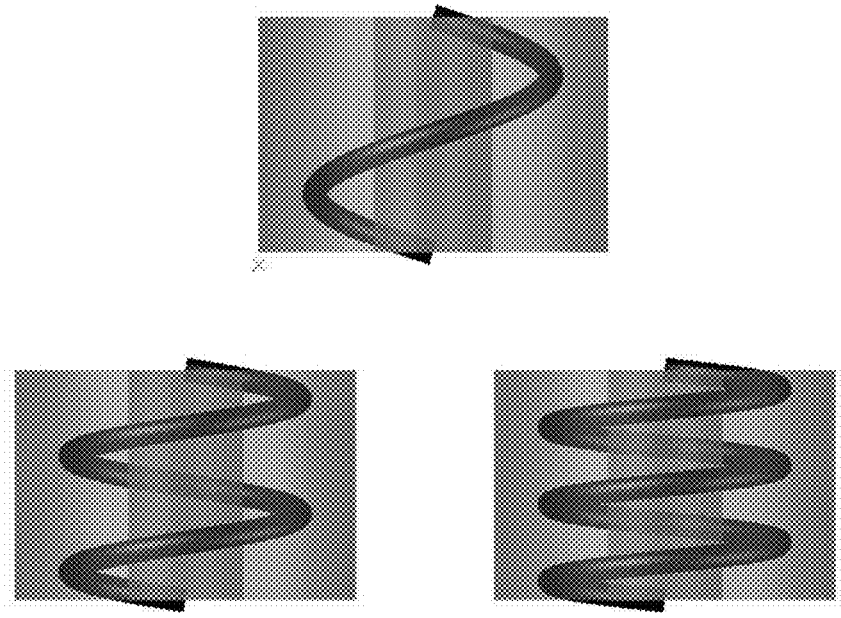
FIGS. 4E and 4F show an example design of the ETTZ energy pile sections in accordance with various illustrative embodiments.

Example ETTZ Energy Pile Sections. FIG. 4E shows three different implementations of the sectioned apparatus, each representing a different implementation of an apparatus having fixed dimensions (e.g., height and diameter). For example, three different unit cells are shown, each having a different pitch angle of the conductive conduit therein. One of the unit cells has a "single spiral loop", one of the unit cells has a double spiral, and one of the unit cells has a triple spiral. When used individually or in a pile, the unit cell having the triple spiral loop will, generally, provide the greatest heat transfer capacity.

Figure 4F:
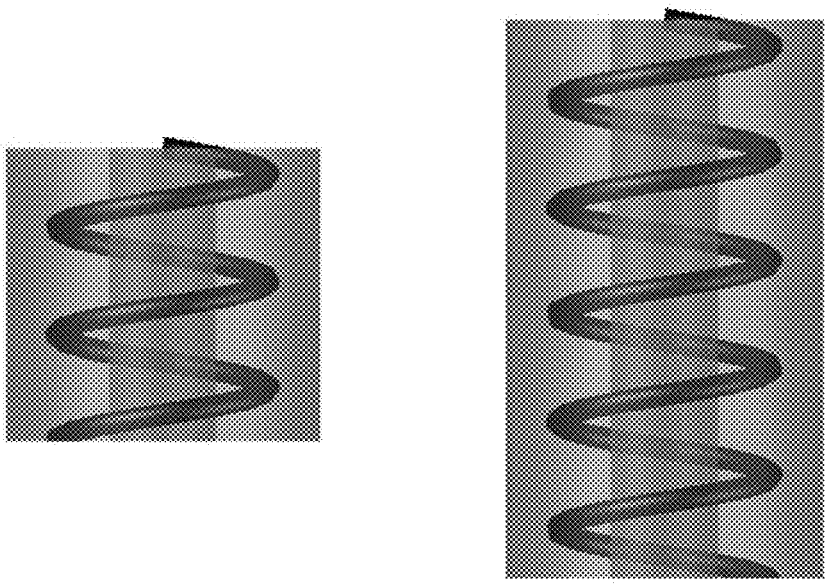

Similarly, FIG. 4F shows an ETTZ energy pile section having a similar conductive conduit (e.g., the same pitch angle) but having a varied height (or length). For example, the ETTZ energy pile section could be manufactured with different standard heights/lengths for different system implementations. The length of the ETTZ energy pile section can be governed by the pitch of the conductive conduit.

Figure 4G:
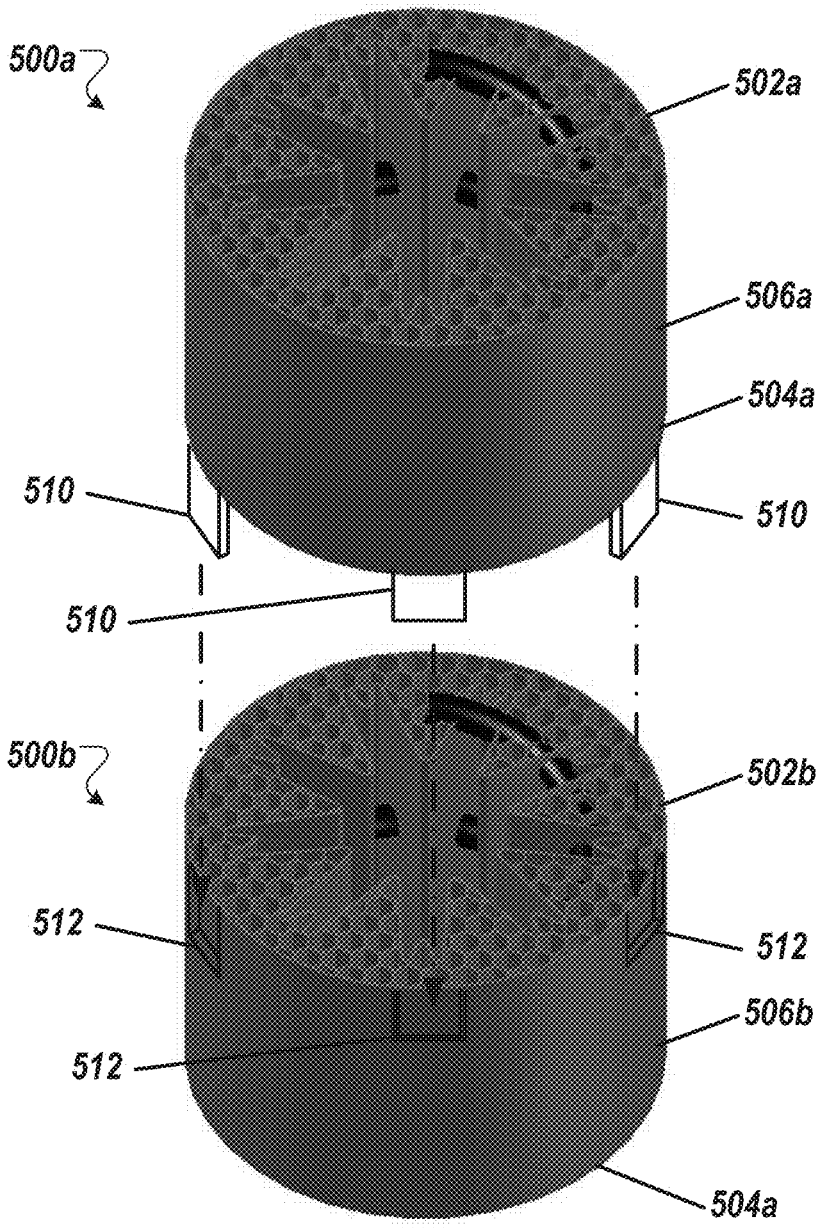
FIG. 4G shows example alignment features incorporated in the ETTZ energy pile sections in accordance with an illustrative embodiment.

Alignment Features. When installing or assembling a pile 30*a* comprising a plurality of apparatuses or unit cells, it may be difficult to properly align and seat one apparatus within another. For example, installation may take place underground. FIG. 4G shows two apparatuses 500*a* and 500*b*, each substantially similar to the apparatus 200 of FIG. 2A and FIG. 3C. The apparatuses 500*a*, 500*b* in FIG. 4G provides an implementation wherein the assembly of a pile is improved by the use of notches and corresponding protrusions.

Similar to the apparatus 200, the apparatus 500*a* includes an outer surface 506*a* extending between a first end 502*a* and a second end 504*a*, and the apparatus 500*b* includes an outer surface 506*b* extending between a first end 502*b* and a second end 504*b*.

The apparatus 500*a* includes protrusions 510 extending from the second end 504*a*. The protrusions 510 are substantially aligned with the outer surface 506*a* and extend in a direction substantially parallel to a central, longitudinal axis of the apparatus 500*a*. As shown, the protrusions 510 are rectangular in shape, having a thickness similar to that of the outer surface 506*a*. However, in other implementations, the protrusions may have a different shape (e.g., triangular or conical). In other implementations, the protrusions are disposed on a different portion of the apparatus 500*a* (e.g., along the inner surface or extending from the plurality of cells between the inner and outer surfaces).

The apparatus 500*b* includes notches 512 defined in the outer surface 506*b* along the first end 502*b* of the two apparatuses 500*b*. The notches 512 have a shape and thickness matching that of the corresponding protrusions 510 on the apparatus 500*a*. As shown, the notches 512 are rectangular in shape, having a thickness similar to that of the outer surface 506*b*. However, in other implementations, the notches may have a different shape (e.g., triangular or conical). In other implementations, the notches are disposed on a different portion of the apparatus 500*b* (e.g., along the inner surface or extending into the plurality of cells between the inner and outer surfaces).

When installing or constructing a pile (e.g., the pile 30*a* of FIG. 1A), the apparatus 500*b* may be placed in a first location (e.g., a manufacturing station, a worksite location, or the bottom of a drilled hole). Then, the apparatus 500*a* is moved into axial alignment with the apparatus 500*b* and lowered on top of it such that the second end 504*a* of the apparatus 500*a* is aligned with and abuts the first end 502*b* of the apparatus 500*b*. To ensure proper alignment, the protrusions 510 on the apparatus 500*a* align with and slide into the notches 512 on the apparatus 500*b*. In cases of misalignment, the apparatus 500*a* may be rotated until the protrusions 510 aligns and engages with the notches 512. In some implementations, tactile, visual, or auditory feedback confirms the coupling of the protrusions 510 and/or apparatus 500*a* with the notches 512 and/or apparatus 500*b*.

Figure 4H:
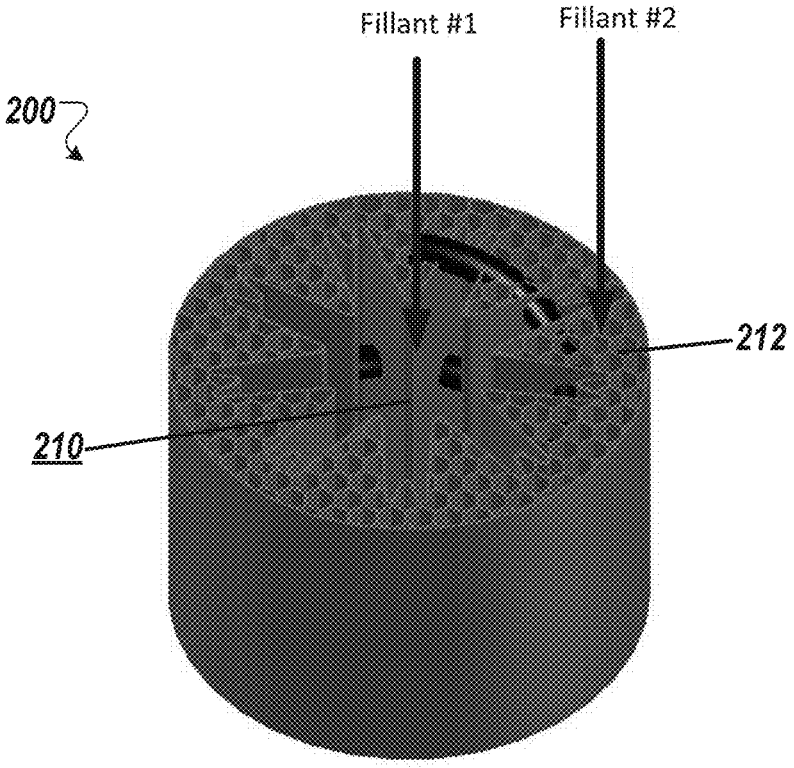
FIG. 4H shows example fillant materials incorporated in the ETTZ energy pile sections in accordance with an illustrative embodiment.

Fillant Material. FIG. 4H shows another view of the apparatus 200 shown in FIG. 2A and FIG. 3C. In FIG. 4H, the apparatus 200 is shown with markings to show where the filler material (e.g., the aggregate, the flowable fill, or the enhanced filler material) may be deposited into the apparatus 200. For example, a first filler material may be deposited into the central channel 210 and the interstitial spaces 238 formed by the radial projections 230. A second filler material may be deposited into the plurality of cells 214 forming the network of cells in between the outer surface 206 and the inner surface 208—corresponding to the thermal transition zone 212. In some implementations, the first filler material is the same as the second filler material. In some implementations, the first filler material is different than the second filler material.

In some implementations, depositing the aggregate or the flowable fill material into the apparatus is facilitated by the shape and arrangement of the plurality of cells forming the network of cells in between the outer surface and the inner surface. For example, the plurality of cells may be sized to facilitate flowable fill material and/or aggregate to flow around the conductive conduit disposed therein. In some implementations, the size of the plurality of cells may account for the diameter of the conductive conduit, plus the aggregate size requirement, plus a margin of error. Each of those additive elements may be adjusted as needed for specific applications.

Additionally, to facilitate the flow of the flowable fill material and/or aggregate material around the conductive conduit, the thermal transition zone and the network of cells therein may define a plurality of fill pathways disposed adjacent and "underneath" the conductive coils. In implementations where the apparatus is filled from the top down, the fill pathways provide a flow path for the flowable fill to reach all areas of the thermal transition zone and each of the plurality of cells therein. In other implementations, the area immediately under the conductive conduit is prefilled during manufacture to eliminate the gap and provide the conductive conduit with a resting surface.

Systems and Methods of Assembly

Figure 5A:
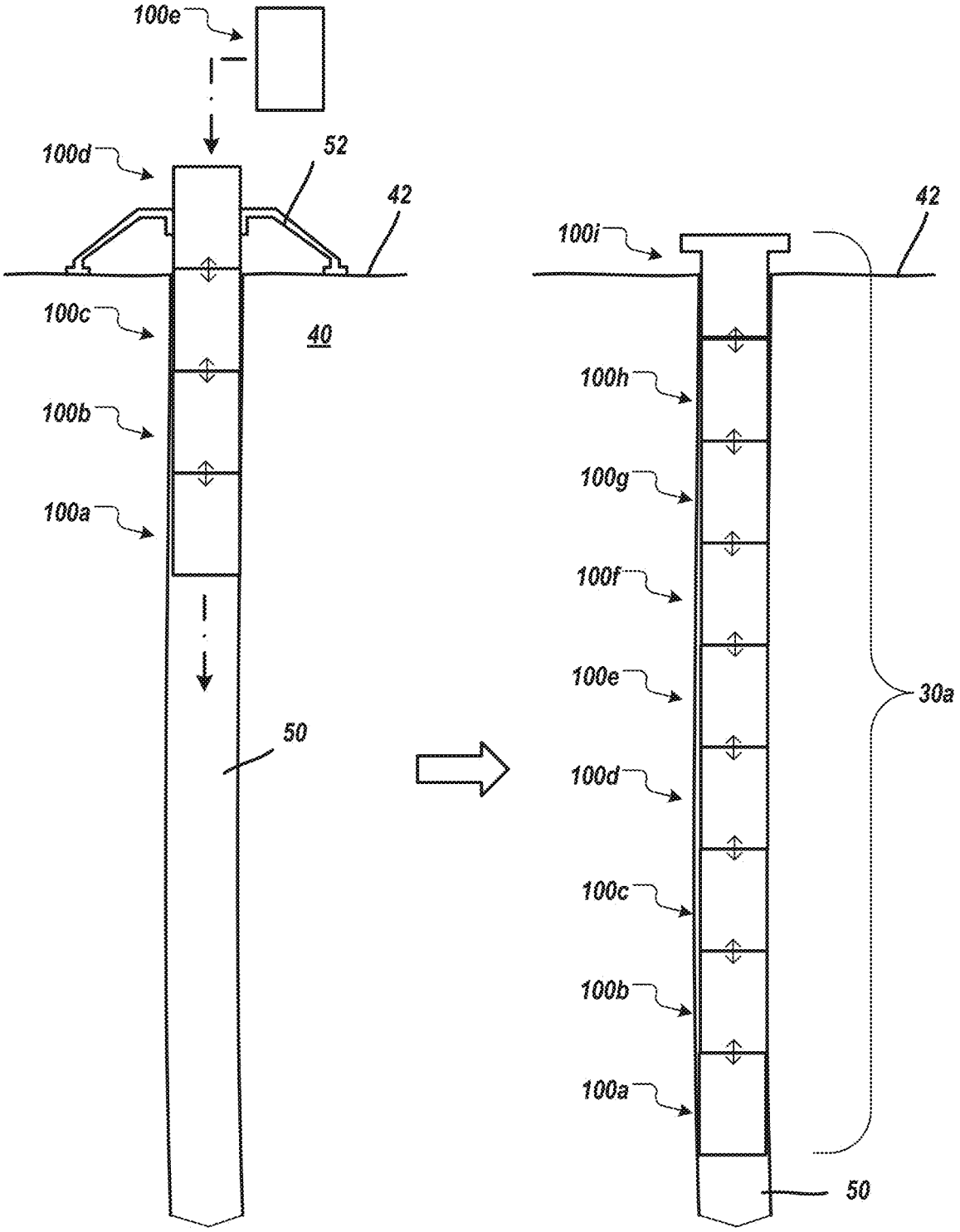
FIGS. 5A-5D each shows a method of assembly of the ETTZ energy pile at a local site (e.g., construction site) in accordance with various illustrative embodiments.
Figure 5B:
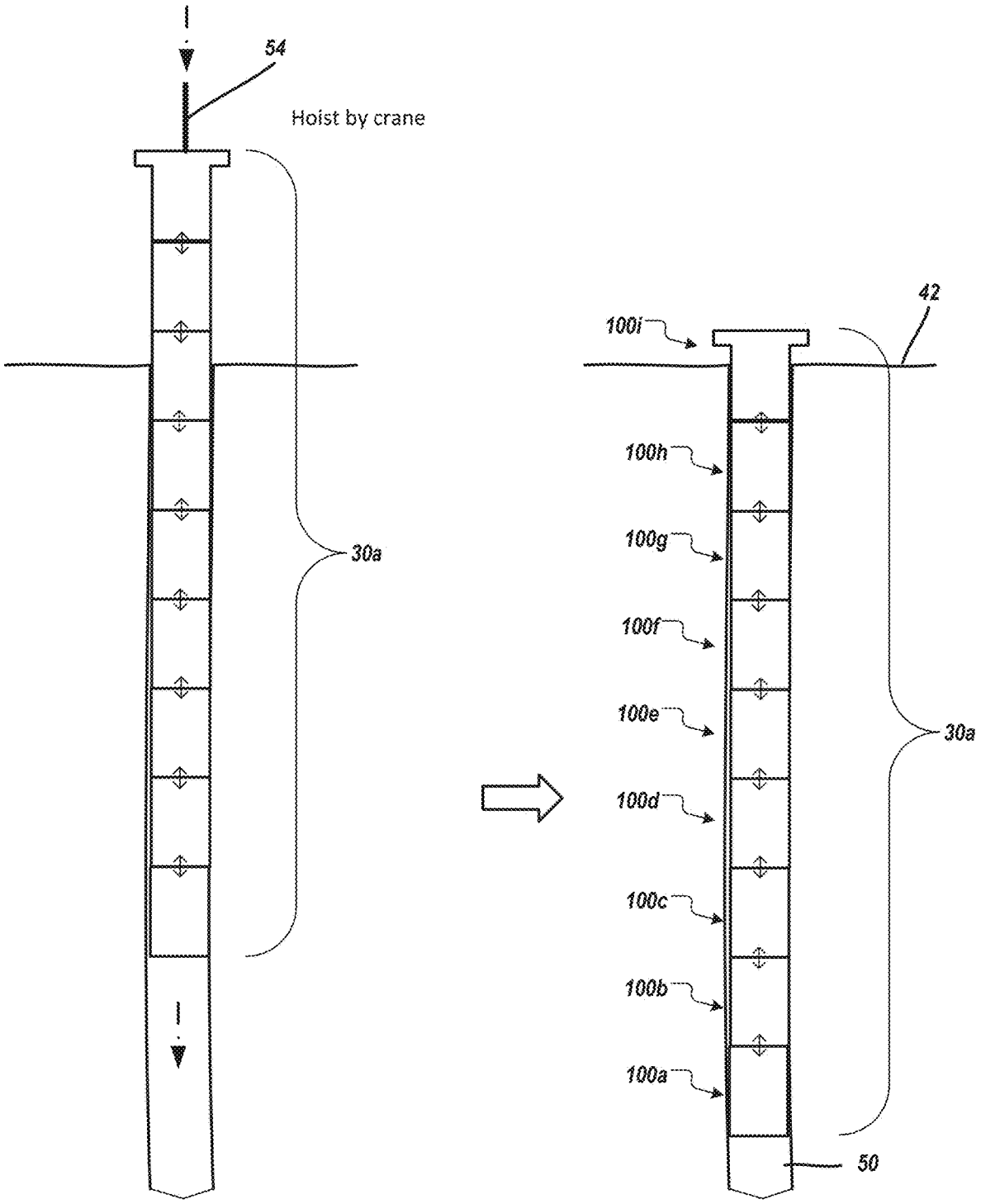

FIGS. 5A and 5B each show a method of assembly of a pile (e.g., the ETTZ energy pile 30*a* of FIG. 1A) at a local site (e.g., a construction site). Similar to FIG. 1A, the ETTZ energy pile 30*a* includes a plurality of apparatuses 100—or sections—shown in FIG. 5A as apparatus 100*a*-100*i*.

To construct the heat exchange system and the ETTZ energy pile 30*a*, a borehole 50 is drilled into the substrate 40. The borehole 50 has a diameter matching approximately that of the apparatus 100*a* (e.g., a diameter of 3 feet). In other implementations, the diameter of the borehole and the associated apparatus may be in the range of 12 inches to 60 inches (e.g., 1, 1.5, 2, 2.5, 3, 3.5, 4, 4.5, or 5 feet in diameter) or from 1 foot to 10 feet (e.g., 1, 2, 3, 4, 5, 6, 7, 8, 9, or 10 feet in diameter). Throughout this disclosure the apparatuses, sections, ETTZ apparatuses, piles, EP's, ETTZ assemblies, and elsewhere named devices may include a variety of dimensions and geometric details, only a few of which are described herein as examples. In some implementations, the systems and devices disclosed herein may have an outer diameter anywhere in the range of 1 to 10 feet.

Once the borehole 50 is drilled, the apparatuses 100*a*-100*i* are installed in the borehole 50 one at a time, on top of each other. A holding mechanism 52 is provided at the top of the borehole 50. The holding mechanism 52 is configured to secure and retain the uppermost apparatus in place above, partially above, or just below the ground surface 42. For example, in FIG. 5A, the apparatus 100*d* is held by the holding mechanism 52, and the apparatus 100*e* is ready to be placed on top of the apparatus 100*d*. The holding mechanism 52 ensures that the apparatus 100*d* (and/or those attached underneath) does not fall to the bottom of the borehole 50 upon installation and that the subsequent apparatus 100*e* can properly be installed on and coupled to the apparatus 100*d*.

Each apparatus is installed and lowered one at a time until the ETTZ energy pile 30*a* is constructed to a desired depth (e.g., in a range of 30 to 200 feet below the ground surface). FIG. 5A shows a fully constructed pile 30*a* on the right side. The apparatus 100*a* on the bottom of the borehole 50 can be unique from the other sections in that the conductive conduit will loop back up instead of extending through the bottom end of the apparatus 100*a*. Additionally, the apparatus 100*i* is unique in that it is configured to couple to a heat exchange assembly above ground.

FIG. 5B shows a method of assembly and installation of a pile (e.g., the pile 30*a* of FIG. 1A and/or FIG. 5A) that has been fully assembled off-site. First, a borehole 50 is drilled into the substrate 40. Then, the pile 30*a* is constructed with the apparatuses 100*a*-100*i* at a different location from the borehole 50 (e.g., a factory, a nearby worksite, or adjacent to the borehole 50). For example, each apparatus 100*a*-100*i* may be coupled to each other by lifting each apparatus with a nearby crane. The apparatus 100*i* may include a hoist or connection point 54 configured to engage with a crane. Once assembled, the entire pile 30*a* is lifted and inserted into the borehole 50. In some implementations, a structural pile is installed into the central channel of the pile 30*a* after the pile 30*a* is installed.

Figure 5C:
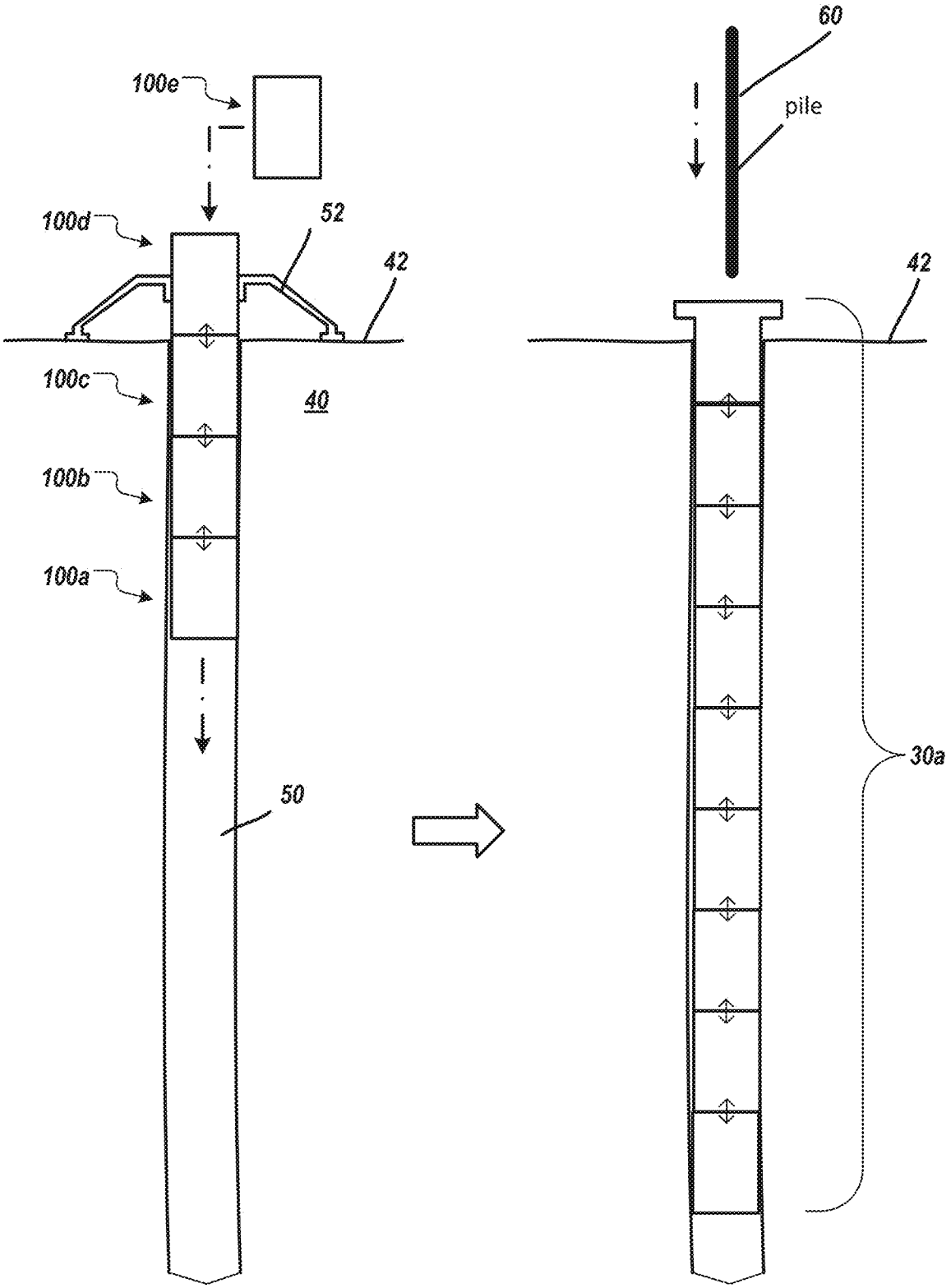

FIG. 5C shows a method of assembly of a pile 30*a* substantially similar to the method shown in FIG. 5A. However, once the pile 30*a* is fully installed in the borehole 50, a structural pile 60 (e.g., a reinforced concrete pile) is inserted into the central channel of the pile 30*a* and driven into the bottom of the borehole 50.

Figure 5D:
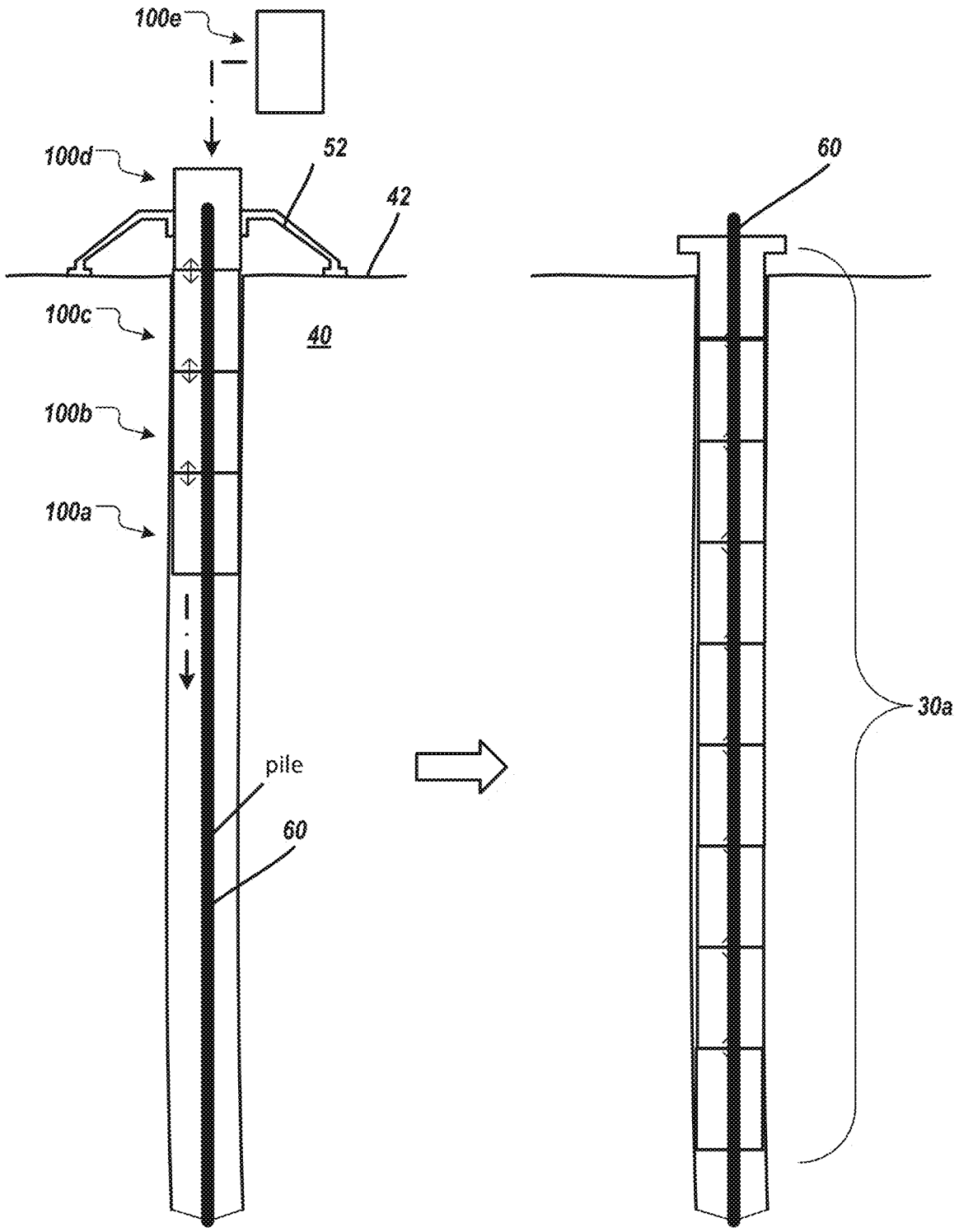

FIG. 5D shows a method of assembly of a pile 30*a* substantially similar to the method shown in FIG. 5B. However, the structural pile 60 (e.g., a reinforced concrete pile) is installed into the borehole 50 first, and the apparatuses 100*a*-100*i* are each installed over and around the structural pile 60. In some implementations, the structural pile 60 has a length longer than the pile 30*a*. In some implementations, the structural pile 60 has a length shorter than the pile 30*a*. in some implementations, the lengths of the structural pile 60 and the pile 30*a* are the same.

Example Method of Assembly

Figure 6A:
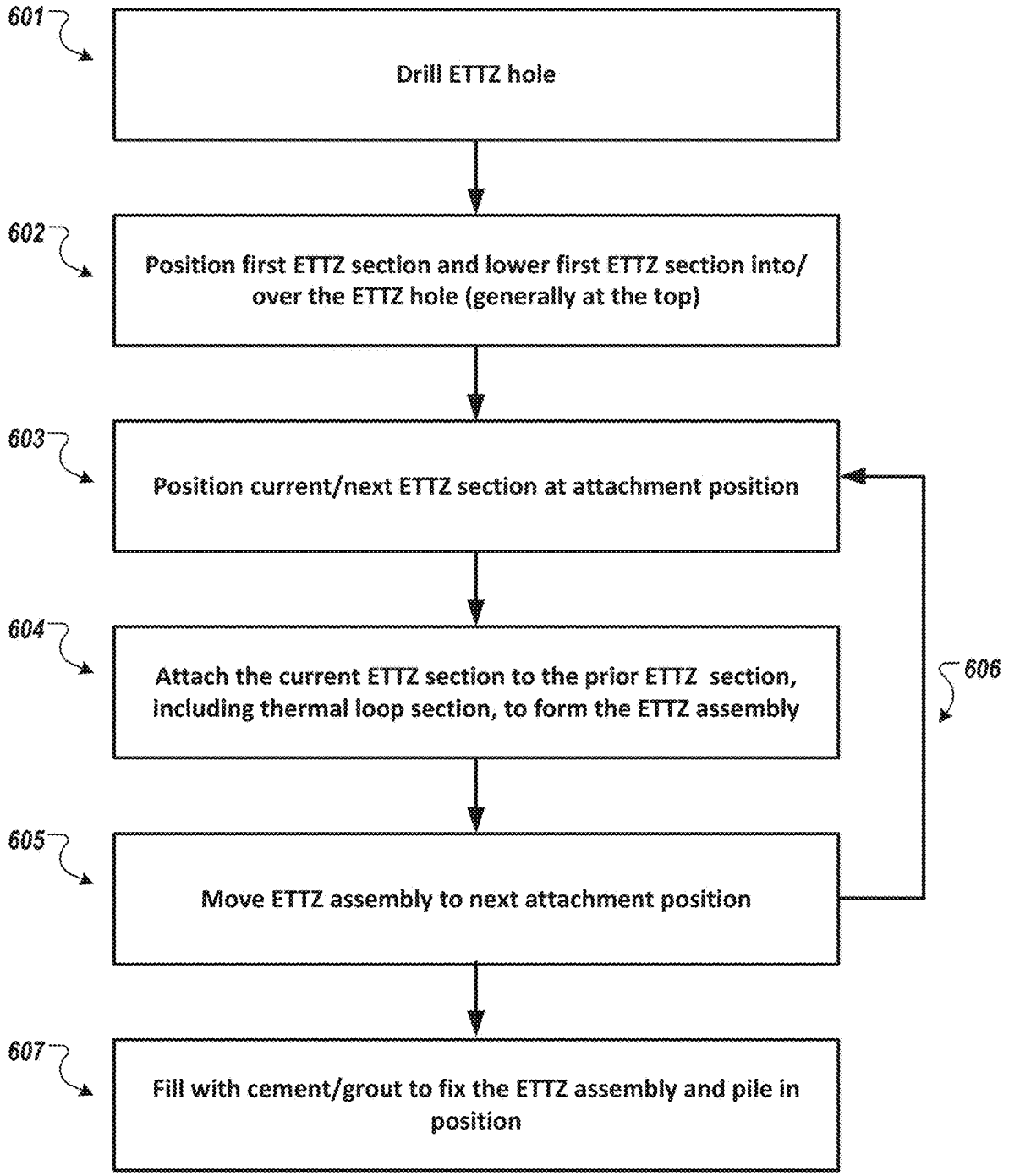
FIGS. 6A-6C each shows flowcharts corresponding to a method of installing and constructing the ETTZ energy piles of FIGS. 5A-5D in accordance with various illustrative embodiments.
Figure 6B:
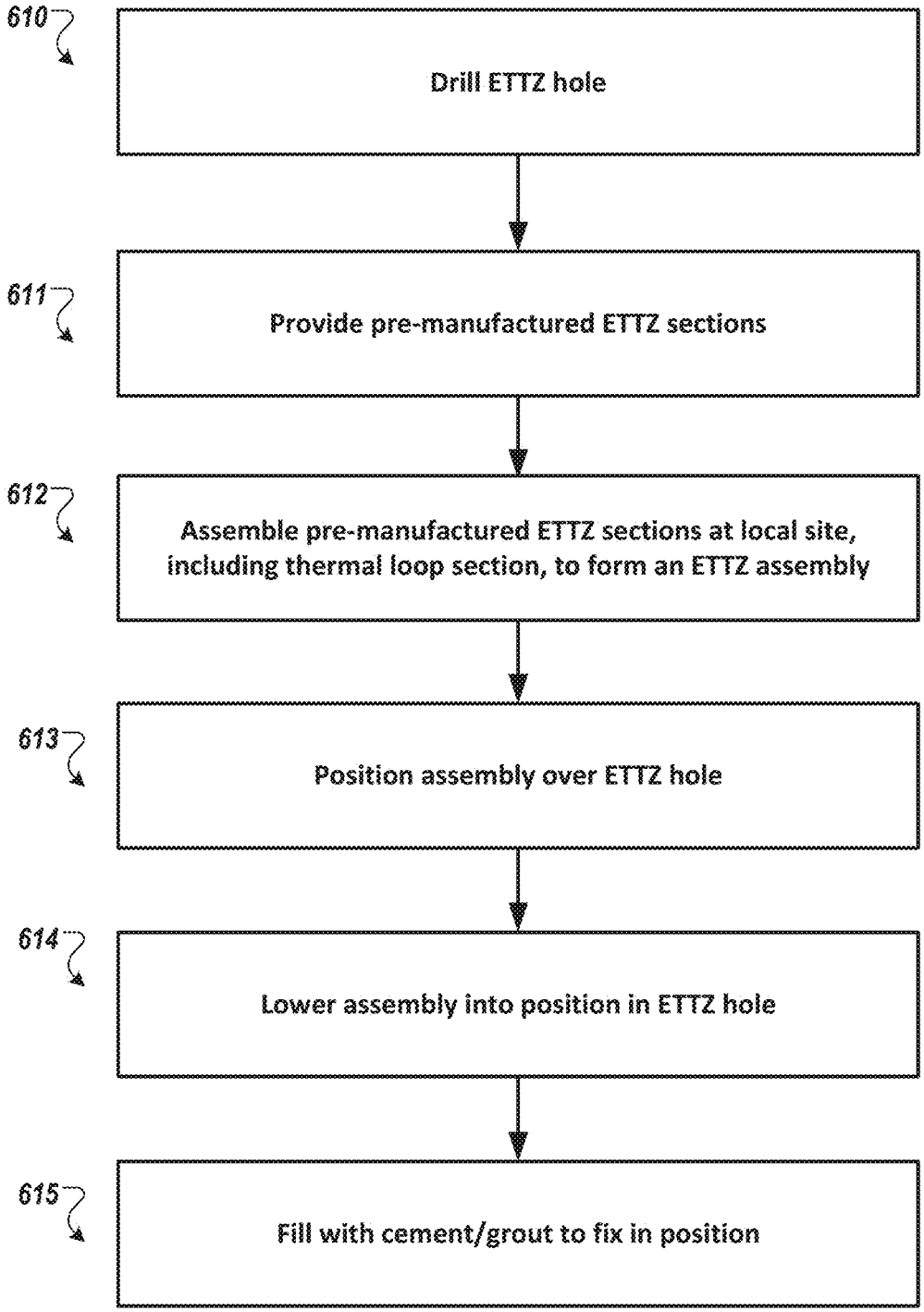
Figure 6C:
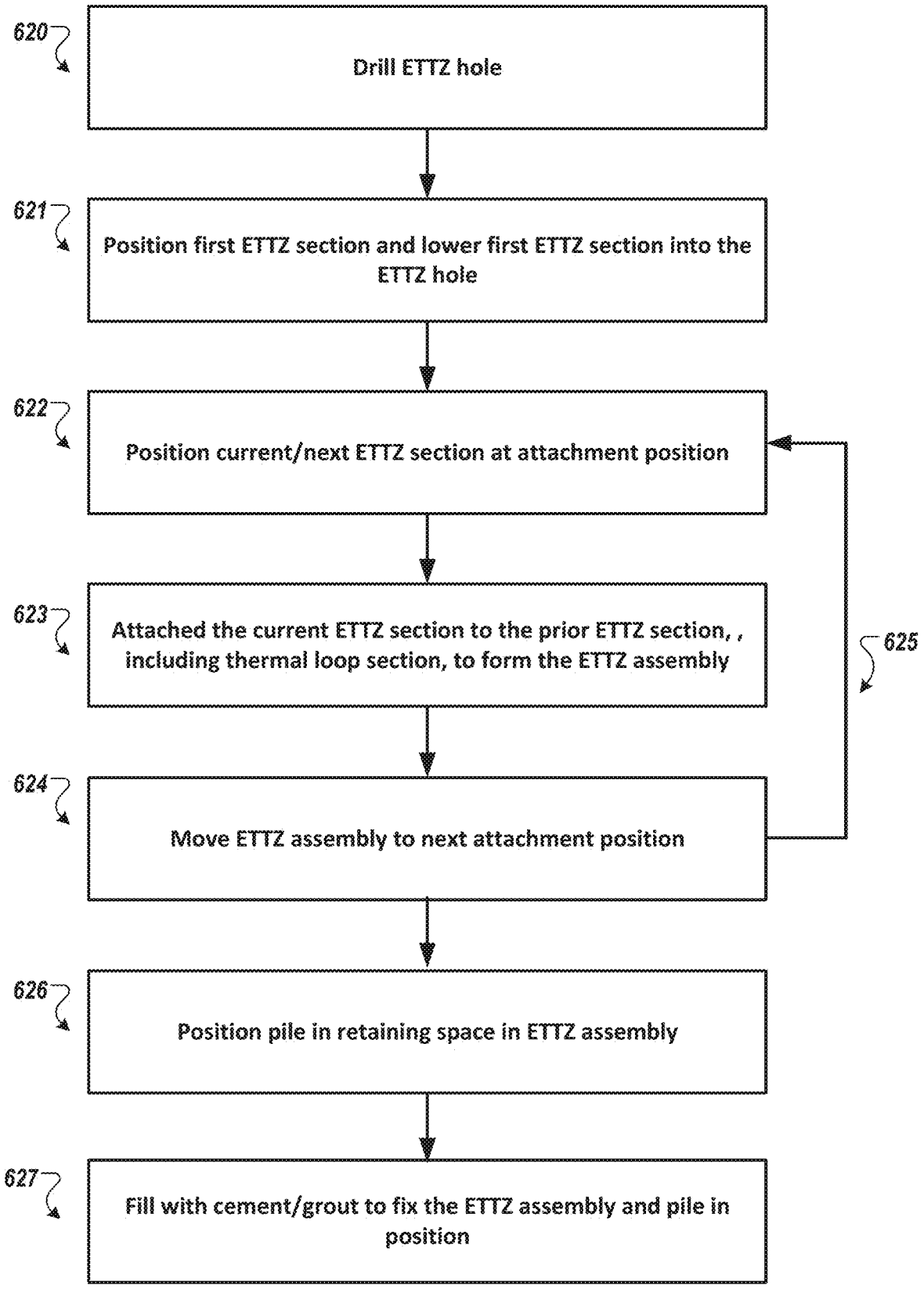

FIGS. 6A-6C display flowcharts corresponding to methods of installing and constructing the piles of apparatuses as shown and described in FIGS. 5A-5D. The "apparatuses" or ETTZ energy pile sections described throughout may also be referred to as "sections" or "engineered thermal transition zone (ETTZ) sections." Thus, the piles may be referred to as "ETTZ assemblies." Furthermore, the borehole may be referred to as an "ETTZ hole."

FIG. 6A describes a method of construction that may be used with the method shown and described in FIG. 5A. First, at step 601, a hole is drilled (e.g., an ETTZ hole) to a desired depth and diameter to fit the pile formed by the plurality of ETTZ sections. Then, at step 602, the first ETTZ section (e.g., the apparatus 100*a*) is positioned over the ETTZ hole and lowered into the hole (e.g., via a crane or a holding mechanism, as shown in FIG. 5A).

Then, at step 603, the next ETTZ section (e.g., the apparatus 100*b*) is positioned at the attachment position over the ETTZ hole and over the first ETTZ section. Then, at step 604, the next ETTZ section (e.g., the apparatus 100*b*) is attached to the first ETTZ section (e.g., the apparatus 100*a*), including coupling the thermal loops (e.g., conductive conduits) together. The attachment of the two ETTZ sections forms an ETTZ assembly. Then, at step 605, the ETTZ assembly is moved into the attachment position (e.g., lowered further into the ETTZ hole with the uppermost ETTZ section held in place).

Branching off from step 605, the method of FIG. 6A includes the option to enter the loop 606. The loop 606 continues to position, attach, and move additional ETTZ sections onto the ETTZ assembly, lowering the ETTZ assembly into the borehole section by section. The loop 606 may repeat for as many iterations as necessary (e.g., matching a desired number of ETTZ sections and/or a desired length of the pile/assembly). Finally, once all ETTZ sections have been installed and the ETTZ assembly lowered to the desired position, the ETTZ assembly is fixed in place with cement or grout at step 607.

FIG. 6B describes a method of installing a prefab ETTZ assembly (e.g., the pile 30*a* in FIG. 5B). First, at step 610, a hole is drilled (e.g., an ETTZ hole) to a desired depth and diameter to fit the pile formed by the plurality of ETTZ sections. Then, at step 611, a plurality of pre-manufactured ETTZ sections (e.g., apparatuses 100*a*-100*i*) are provided. At step 612, the plurality of pre-manufactured ETTZ sections is assembled at a local site, including the coupling of the thermal loop (e.g., conductive conduits) thereof, forming an ETTZ assembly.

Then, at step 613, the ETTZ assembly is positioned over an ETTZ hole (e.g., over a borehole via a crane coupled to the uppermost ETTZ section). At step 614, the ETTZ assembly is lowered into the ETTZ hole. Finally, once the ETTZ assembly is lowered to the desired position, the ETTZ assembly is fixed in place with cement or grout at step 615.

FIG. 6C describes a method of construction that may be used with the method shown and described in FIG. 5C. First, at step 620, a hole is drilled (e.g., an ETTZ hole) to a desired depth and diameter to fit the pile formed by the plurality of ETTZ sections. Then, at step 621, the first ETTZ section (e.g., the apparatus 100*a*) is positioned over the ETTZ hole and lowered into the hole (e.g., via a crane or a holding mechanism, as shown in FIG. 5C).

Then, at step 622, the next ETTZ section (e.g., the apparatus 100*b*) is positioned at the attachment position over the ETTZ hole and over the first ETTZ section. Then, at step 623, the next ETTZ section (e.g., the apparatus 100*b*) is attached to the first ETTZ section (e.g., the apparatus 100*a*), including coupling the thermal loops (e.g., conductive conduits) together. The attachment of the two ETTZ sections forms an ETTZ assembly. Then, at step 624, the ETTZ assembly is moved into the attachment position (e.g., lowered further into the ETTZ hole with the uppermost ETTZ section held in place).

Branching off from step 624, the method of FIG. 6C includes the option to enter the loop 625. The loop 625 continues to position, attach, and move additional ETTZ sections onto the ETTZ assembly, lowering the ETTZ assembly into the borehole section by section. The loop 625 may repeat for as many iterations as necessary (e.g., matching a desired number of ETTZ sections and/or a desired length of the pile/assembly).

Once all ETTZ sections have been installed and the ETTZ assembly lowered to the desired position, at step 626, a pile (e.g., the structural pile 60 comprising reinforced concrete) is positioned in the retaining space in the ETTZ assembly (e.g., the central channel defined by the plurality of apparatuses). In some implementations, step 626 is provided before step 621 such that the ETTZ sections are installed over the installed structural pile. Finally, at step 627, the ETTZ assembly and the structural pile are fixed in place with cement or grout.

Experimental Results and Additional Examples

Figure 7A:
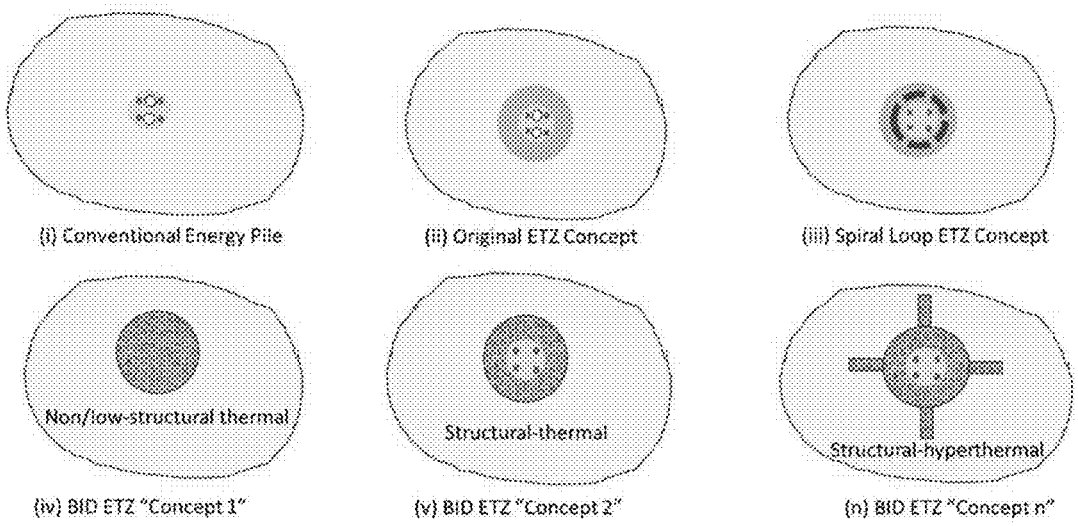
FIGS. 7A-7C show simulation results of thermal dissipation capacity and power ratios for energy piles and ETTZ energy piles in accordance with various illustrative embodiments.

A study was conducted to evaluate and develop ETTZ energy piles. FIG. 7A shows examples of engineered thermal transition zone structures and energy pile structures. In the study, simulations were performed to show the thermal performance of the ETTZ energy piles and energy piles.

Figure 7B:
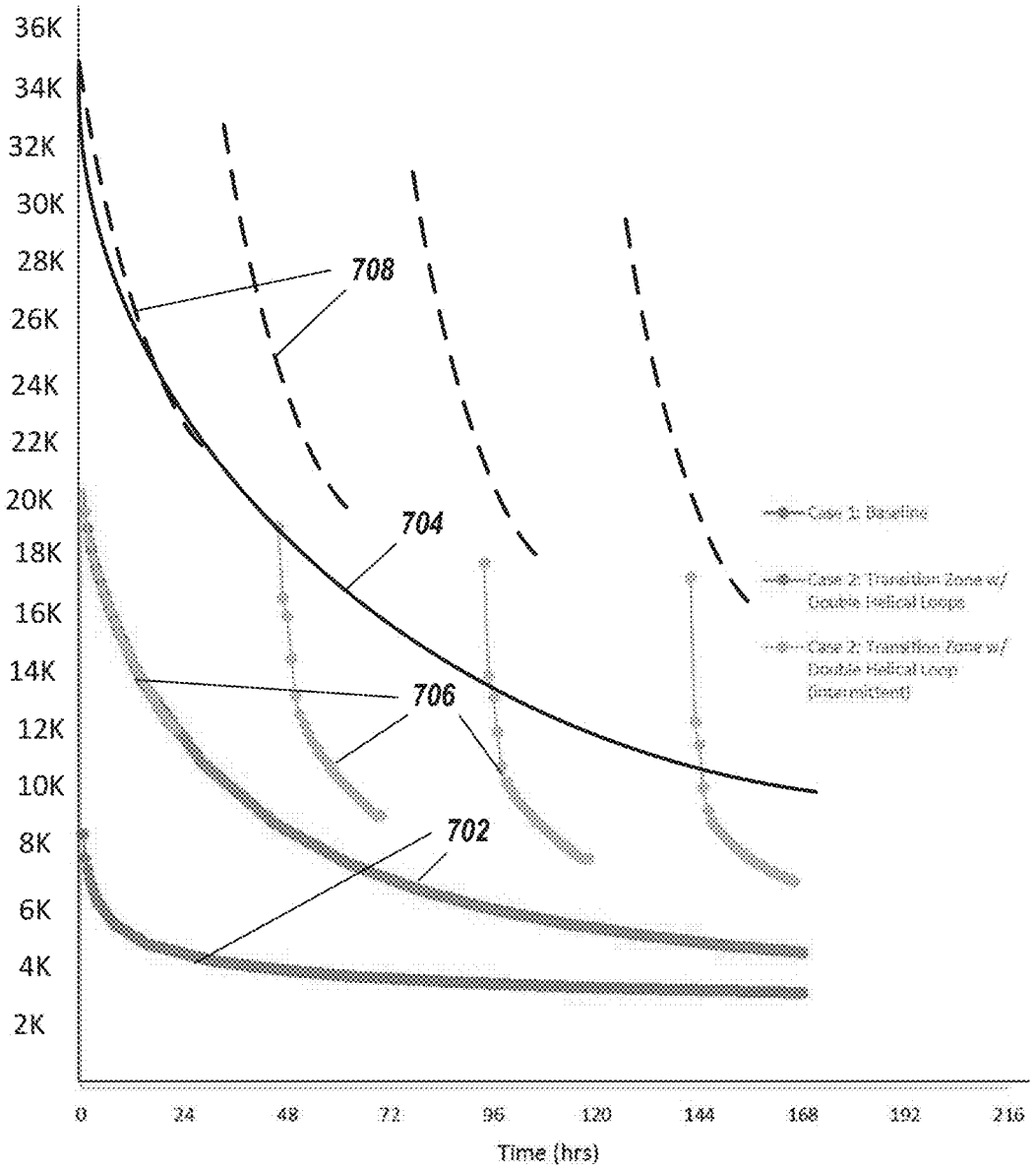

Thermal dissipation capacity. FIG. 7B shows a graph of FIG. 7B shows plots of simulated results for the dissipation capacity of the structure (i)-(iii) in FIG. 7A. Additionally, FIG. 7B shows the expected improvements in thermal dissipation capacity for the ETTZ energy piles (e.g., 100). The simulated results 702 can be considered as the lower bound for energy piles to which the ETTZ energy pile could improve. The lines 704 are example expected thermal dissipation capacity for the ETTZ energy piles.

FIG. 7B also shows a set of thermal dissipation capacity curves 706 corresponding to energy piles operating in intermittent mode operation. The premise is that, in a daily or weekly cycle, the thermal regulation can be turned on and then turned off. As the thermal regulation is turned on and then turned off, there is a period of recovery that is gained. Lines 708 shows corresponding thermal dissipation capacity curves for ETTZ energy piles.

Figure 7C:
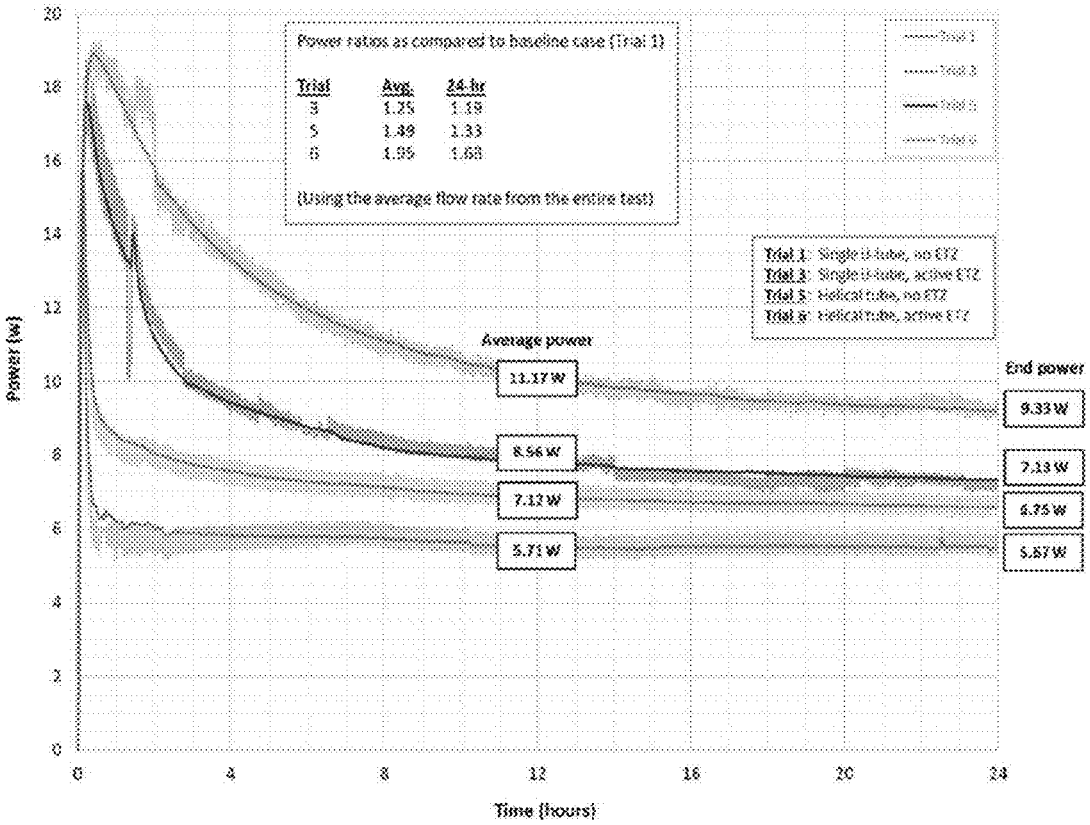

Power Ratios. FIG. 7C is a graph of the power ratios for different experimental trials comparing the shape of the conductive conduit (single U-shaped tube vs helical/spiral tube), and the presence or absence of the engineering thermal transition zone (ETTZ). As shown, the trial with the helical tube and the active ETTZ present showed the fastest power transfer (e.g., heat transfer).

Discussion

Ground heat exchange systems can include the addition of fluid circulation loops in the structural pile foundation. Fluid conduits allow fluid to pump through structural piles, distributing or collecting heat via the piles. This approach has many limitations, including limited space available for the thermal components due to the presence of reinforcing steel to produce the desired structural capacity for the pile foundation system.

There is ongoing research on the structural effects of the thermal fluid system on the pile and how to maintain structural integrity in the presence of thermal fluctuations. However, the thermal efficiency of the system has not been substantially addressed. Concrete piles alone do not provide an efficient heat transfer medium. Thus, existing systems fail to effectively transfer heat between the pile and the earth.

Configuration of Certain Implementations

The construction and arrangement of the systems and methods as shown in the various implementations, are illustrative only. Although only a few implementations have been described in detail in this disclosure, many modifications are possible (e.g., variations in sizes, dimensions, structures, shapes, and proportions of the various elements, values of parameters, mounting arrangements, use of materials, colors, orientations, etc.). For example, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative implementations. Other substitutions, modifications, changes, and omissions may be made in the design, operating conditions, and arrangement of the implementations without departing from the scope of the present disclosure.

It is to be understood that the methods and systems are not limited to specific synthetic methods, specific components, or to particular compositions. It is also to be understood that the terminology used herein is for the purpose of describing particular implementations only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another implementation includes from the one particular value and/or to the other particular value. Similarly, when values are expressed as approximations, by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal implementation. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific implementation or combination of implementations of the disclosed methods.

What is claimed is:

1. An apparatus configured for thermal and/or structural support, the apparatus comprising:

an outer surface extending between a first end and a second end of the apparatus;

an inner surface spaced apart and radially inward from the outer surface and defining a central channel of the apparatus;

a thermal transition zone extending between the outer surface and the inner surface, the thermal transition zone configured to facilitate heat transfer between the inner surface and the outer surface, wherein the thermal transition zone comprises a plurality of cells extending between the outer surface and the inner surface to define a patterned network of the plurality of cells; and a conductive conduit extending through at least the thermal transition zone from the first end to the second end of the apparatus and spiraling around the central channel of the apparatus with a pitch, the conductive conduit configured to transfer heat into the thermal transition zone.

2. The apparatus of claim 1, wherein the inner surface further comprises a pattern of radial projections spanning a first circumference and a second circumference disposed radially inward from the first circumference of the inner surface, wherein the second circumference of the inner surface defines the central channel of the apparatus.

3. The apparatus of claim 1, wherein each cell of the plurality of cells are hexagonal in shape.

4. The apparatus of claim 1, wherein the conductive conduit further extends through at least a portion of the inner surface.

5. The apparatus of claim 4, wherein the conductive conduit further extends through a pattern of radial projections of the inner surface.

6. The apparatus of claim 1, wherein a diameter of the central channel is about one-third of a diameter of the outer surface.

7. The apparatus of claim 1, wherein the outer surface is substantially circular.

8. The apparatus of claim 1, wherein the outer surface further comprises at least one projection extending radially outward and configured for increased thermal conductivity.

9. The apparatus of claim 1, wherein the apparatus is configured to couple to one or more additional apparatus, including a second apparatus, to form a structural pile, wherein the second apparatus comprises:

an outer surface extending between a first end and a second end of the apparatus;

an inner surface spaced apart and radially inward from the outer surface, the inner surface comprising a pattern of radial projections spanning a first circumference and a second circumference disposed radially inward from the first circumference of the inner surface, wherein the second circumference of the inner surface defines a central channel of the apparatus;

a thermal transition zone extending between the outer surface and the inner surface, the thermal transition zone configured to facilitate heat transfer between the inner surface and the outer surface; and a conductive conduit extending through at least the thermal transition zone from the first end to the second end of the apparatus and spiraling around the central channel of the apparatus with a pitch, the conductive conduit configured to transfer heat into the thermal transition zone.

10. A pile comprising:

a structural pile comprising a first end and a second end opposite and spaced apart from the first end, the structural pile configured to support a load;

a thermal pile disposed around the structural pile, the thermal pile comprising a first end and a second end, wherein the second end of the thermal pile extends beyond the second end of the structural pile, wherein the pile has enhanced thermal properties compared to the structural pile, the thermal pile comprising:

an outer surface extending between the first end and the second end of the thermal pile;

an inner surface spaced apart and radially inward from the outer surface defining a central channel of the thermal pile within which the structural pile is disposed;

a thermal transition zone extending between the outer surface and the inner surface, the thermal transition zone configured to facilitate heat transfer between the inner surface and the outer surface; and a conductive conduit extending through at least the thermal transition zone from the first end to the second end of the thermal pile and spiraling around the central channel of the thermal pile with a pitch, the conductive conduit configured to transfer heat into the thermal transition zone.

11. The pile of claim 10, wherein the inner surface further comprises a pattern of radial projections spanning a first circumference and a second circumference disposed radially inward from the first circumference of the inner surface, wherein the second circumference of the inner surface defines the central channel of the pile.

12. The pile of claim 10, wherein the pile is installed in a bulk material, and heat is transferred from the conductive conduit, through the thermal transition zone, an into the bulk material.

13. The pile of claim 10, further comprising:

a fluid pumping system comprising a fluid source coupled to and in fluid communication with the conductive conduit and a pump configured to urge fluid from the fluid source along the conductive conduit.

14. The pile of claim 10, wherein a diameter of the structural pile is 12 inches, and a diameter of the outer surface of the thermal pile is 36 inches.

15. The pile of claim 10, wherein the thermal transition zone comprises a plurality of cells extending between the outer surface and the inner surface to define a patterned network of the plurality of cells.

16. A method of fabricating a structural and thermal pile system, the method comprising:

providing a thermal pile comprising:

an outer surface extending between a first end and a second end of the thermal pile;

an inner surface spaced apart and radially inward from the outer surface and defining a central channel within which the structural pile is disposed;

a thermal transition zone extending between the outer surface and the inner surface, the thermal transition zone configured to facilitate heat transfer between the inner surface and the outer surface; and a conductive conduit extending through at least the thermal transition zone from the first end to the second end of the thermal pile and spiraling around the central channel of the thermal pile with a pitch, the conductive conduit configured to transfer heat into the thermal transition zone;

installing the thermal pile into a bulk material; and installing a structural pile into the central channel of the thermal pile, structural pile comprising a first end and a second end opposite and spaced apart from the first end, wherein the second end of the thermal pile extends beyond the second end of the structural pile.

17. The method of claim 16, further comprising:

coupling the conductive conduit to a fluid pumping system comprising a fluid pump and a fluid source in fluid communication with the conductive conduit; and activating the fluid pump to urge fluid from the fluid source and through the conductive conduit.

18. The method of claim 17, wherein heat from the fluid is transferred into the thermal transition zone of the thermal pile and further into the bulk material.

19. The method of claim 16, wherein the thermal transition zone comprises a plurality of cells extending between the outer surface and the inner surface to define a patterned network of the plurality of cells.

* * * * *